US007308967B1

(12) United States Patent
Hoel

(10) Patent No.: US 7,308,967 B1
(45) Date of Patent: Dec. 18, 2007

(54) SOUND SUPPRESSOR

(75) Inventor: Thomas Trail Hoel, Arvada, CO (US)

(73) Assignee: Gemini Technologies, Inc., Boise, ID (US)

( * ) Notice: Subject to any disclaimer, the term of this patent is extended or adjusted under 35 U.S.C. 154(b) by 254 days.

(21) Appl. No.: 11/284,287

(22) Filed: Nov. 21, 2005

(51) Int. Cl.
*F41A 21/30* (2006.01)
*F01N 1/02* (2006.01)
*F01N 1/08* (2006.01)

(52) U.S. Cl. ..... 181/223; 181/249; 181/255; 181/270; 89/14.4

(58) Field of Classification Search ..... 181/223, 181/233, 249, 255, 269, 270, 272, 281; 89/14.4, 89/14.2
See application file for complete search history.

(56) References Cited

U.S. PATENT DOCUMENTS

| | | | | | |
|---|---|---|---|---|---|
| 951,770 | A * | 3/1910 | Miller | ..... | 181/253 |
| 981,584 | A * | 1/1911 | Miller | ..... | 181/253 |
| 1,081,348 | A * | 12/1913 | Unke et al. | ..... | 181/264 |
| 1,259,251 | A * | 3/1918 | Love | ..... | 181/223 |
| 2,925,755 | A * | 2/1960 | Krus | ..... | 89/14.3 |
| 3,385,164 | A * | 5/1968 | Hubner et al. | ..... | 89/14.4 |
| 3,748,956 | A * | 7/1973 | Hubner | ..... | 89/14.4 |
| 4,291,610 | A * | 9/1981 | Waiser | ..... | 89/14.4 |
| 4,576,083 | A * | 3/1986 | Seberger, Jr. | ..... | 89/14.4 |
| 4,588,043 | A | 5/1986 | Finn | | |
| 4,907,488 | A * | 3/1990 | Seberger | ..... | 89/14.4 |
| 5,029,512 | A | 7/1991 | Latka | | |
| 5,164,535 | A | 11/1992 | Leasure | | |
| 5,679,916 | A * | 10/1997 | Weichert | ..... | 89/14.4 |
| 6,308,609 | B1 * | 10/2001 | Davies | ..... | 89/14.4 |
| 6,374,718 | B1 * | 4/2002 | Rescigno et al. | ..... | 89/14.4 |
| 6,425,310 | B1 * | 7/2002 | Champion | ..... | 89/14.3 |
| 6,575,074 | B1 | 6/2003 | Gaddini | | |
| 7,207,258 | B1 * | 4/2007 | Scanlon | ..... | 89/198 |
| 7,237,467 | B1 * | 7/2007 | Melton | ..... | 89/14.4 |

FOREIGN PATENT DOCUMENTS

WO WO 8903958 A1 * 5/1989

* cited by examiner

*Primary Examiner*—Edgardo San Martin

(57) ABSTRACT

A sound suppressor for a firearm for reducing sound and flash levels upon the discharge of a firearm comprises a cylindrical housing, a proximal end cap with means for attachment to a firearm and to the cylindrical housing, a distal end cap with means for attachment to the housing, and a plurality of baffles positioned within the housing and between the proximal end and distal end caps of the suppressor. A separate cylindrical spacer element is positioned between the proximal end cap of the suppressor and the first baffle. This spacer provides axial positioning of the baffles within the cylindrical housing of the suppressor. The distal end cap of the suppressor is provided with a concentric circular hole or aperture for the projectile to pass through the end of the suppressor. In a number of preferred embodiments, the sound suppressor utilizes baffles that use two or more of the disclosed features that enhance reduction of sound and flash, these features being a rearward conical protrusion provided with multi-annular steps, a flange with an external diameter slightly less than the internal diameter of the cylindrical housing, a frontal turbulence generation structure, a frontal turbulence generation structure provided with at least one cut-out, a turbulence generation structure, and gas cross-flow enhancement cuts positioned on the proximal and distal sides of the baffles.

10 Claims, 23 Drawing Sheets

SECTION A

SOUND SUPPRESSOR

This application claims priority from the provisional application filed Nov. 5, 2004, Ser. No. 60/625,069.

BACKGROUND OF THE INVENTION

1. Field of the Invention

The present invention relates to a sound suppressor for a firearm, and more particularly to baffles for use in a sound suppressor for a firearm.

2. Background of the Invention

Sound suppressors for firearms are well known in the prior art, and many have been patented over a considerable period of time. Many different techniques have been developed and patented, and baffles of varying designs have been extensively used. The aim and intention of a sound suppressor, regardless of the technique used, is to reduce the pressure and velocity of the propellant gases from the sound suppressor so that the resulting sound level is significantly reduced.

Quite complex baffle structures are known in the prior art. Some of these baffles have more recently used asymmetric features, such as slanted sidewalls or baffles that have been positioned at an angle to the bore, to achieve high levels of sound reduction. U.S. Pat. No. 4,588,043 (Finn) and U.S. Pat. No. 5,164,535 (Leasure) are indicative of the complex baffles using slanted sidewalls or asymmetric cuts into the bore of the baffles. Known prior art as practiced also includes baffles known as 'K' baffles, where the baffle consists of a flat flange joined to a conical section by a web. An inner chamber was formed between the front face of the flat flange and the rear face of the conical section. The 'K' baffle first appeared during the mid-1980s, and while initially symmetrical venting or porting was used to vent gases into the inner chamber between the rear and front faces of the baffle, slanted sidewalls were used to improve the performance of the 'K' baffle, as well as asymmetric cuts or scoops on the rear face and on the conical front face, with the scoop on the front face penetrating through the conical front face and into the inner chamber. This had the effect of venting gases into the inner chamber and this enhanced the sound reduction of the suppressor. These asymmetric cuts or scoops are similar to the slanted sidewall feature of the Finn patent in that the cuts or scoops are positioned 180 degrees apart. However, while such a modified 'K' baffle worked well with pistol caliber firearms, the asymmetry caused some detrimental effect on accuracy when used with rifle caliber firearms, and required an increase in the size of the bore aperture of the baffle to ensure minimization of bullet yaw. This would otherwise result in projectiles striking the baffles and the end cap of the suppressor. What is required is a baffle that offers high levels of sound reduction, and minimizes bullet yaw and enhance and/or maintain the normal accuracy of the host firearm.

Accordingly, it is an object of this invention to provide a sound suppressor for a firearm using baffles that have little or no detrimental effect on the accuracy of the fired projectile, and produce high levels of sound and flash reduction. This is achieved through the use of a number of structures that may be used with a variety of different baffles, and the use of these structures provide enhanced performance.

Additional objects, advantages, and novel features of the invention will be set forth in part in the description as follows, and in part will become apparent to those skilled in the art upon examination of the following, or may be learned by practice of the invention.

SUMMARY OF THE INVENTION

The present invention is a sound suppressor for a firearm for reducing sound and flash levels upon the discharge of a firearm. The sound suppressor comprises a cylindrical housing, a proximal end cap with means for attachment to a firearm and to the cylindrical housing, a distal end cap with means for attachment to the housing, and a plurality of baffles positioned within the housing and between the proximal end and distal end caps of the suppressor. Separate cylindrical spacer elements are positioned between the proximal and distal ends of the suppressor and between the baffles. These spacers provide axial positioning of the baffles within the cylindrical housing of the suppressor. The distal end cap of the suppressor is provided with a concentric circular hole or aperture for the projectile to pass through the end of the suppressor. Expansion chambers are formed between the baffles within the suppressor and the proximal and distal end caps of the suppressor.

In a number of preferred embodiments, the sound suppressor utilizes baffles that use two or more of the disclosed features that enhance reduction of sound and flash, these features being a rearward conical protrusion provided with multi-annular steps, a flange with an external diameter slightly less than the internal diameter of the cylindrical housing, a frontal turbulence generation structure, a frontal turbulence generation structure provided with at least one cut-out, a turbulence generation structure, and gas cross-flow enhancement cuts positioned on the proximal and distal sides of the baffles. The rearward conical protrusion provided with multi-annular steps may be positioned on the proximal face of a flat baffle or a baffle that uses a flat rear face as a part of the baffle structure or as a part of a conical baffle. The multi-annular steps may also be provided with a tapered surface, whereby the tapered surface tapers inward from the outside diameter of each step and rearward towards the outside diameter of the next annular step. The flange with a diameter slightly less than the internal diameter of the suppressor housing may be positioned on the exterior surface of a conical baffle or a baffle that includes a conical section as part of the baffle. The frontal turbulence generation structure comprises an annular inward protruding lip, with the lip protruding inwards towards the axis of the suppressor, and is positioned on the distal side of a baffle. In the case of a conical baffle or a baffle that includes a conical section as part of the baffle, the frontal turbulence generation structure may also be positioned within the conical baffle or conical section of a baffle. The annular inward protruding lip of the frontal turbulence generation structure may have a tapered surface on the proximal side of the lip or the surface may decrease in thickness with respect to the center axis of the baffle. The frontal turbulence generation structure may also be provided with at least one cut out, whereby a portion of the frontal turbulence generation structure is removed, or there may be a plurality of cut outs in the structure. The gas cross-flow enhancement cuts consist of at least one cut to the bore of a baffle. These cuts may be positioned on either the proximal or distal sides of the baffle or both the proximal and distal sides of the baffle. On the proximal side of a baffle, the bore hole of a baffle is modified by at least one cut that is positioned eccentrically to the axis of a baffle and the cut consists of a portion of the baffle being removed from the bore. On the distal side of a baffle, the bore hole of a baffle is modified by at least one cut that is positioned eccentrically to the axis of the baffle, and the cut consists of a portion of the baffle being removed from the bore or in a number of preferred embodiments, the cut may be through the baffle wall or in the baffle wall.

In a preferred embodiment, the baffle is provided with a rear flat flange, and a conical section at the front and connected to the flat flange by a web or a parallel-sided tube. An annular chamber is provided between the rear flat flange and the conical section at the front of the baffle, and is defined by the front face of the rear flat flange, the outer surface of the conical section, the outer surface of the web and the inside diameter of the suppressor housing. The rear flat flange of the baffle is provided with at least two gas ports that are angled with respect to the axis of the baffles. The baffle is also provided with a rearward conical protrusion provided with multi-annular steps positioned concentrically on the rear flat flange with the multi-annular steps decreasing in diameter with respect to the distance from the rear flat flange. The multi-annular steps may also be provided with a tapered surface, whereby the tapered surface tapers inward from the outside diameter of each step and rearward towards the outside diameter of the next annular step as positioned with respect to the distance from the rear flat flange. The conical section of the baffle is also provided with a frontal turbulence generation structure that comprises an annular inward protruding lip, with the lip protruding inwards towards the axis of the baffles. The frontal turbulence generation structure may be provided with at least one cut out, whereby a portion of the frontal turbulence generation structure is removed or there may be a plurality of cut outs in the structure. The annular inward protruding lip of the frontal turbulence generation structure may have a tapered surface on the proximal side of the lip or the surface may decrease in thickness with respect to the center axis of the baffle. A flat flange with a diameter slightly less than the internal diameter of the suppressor housing is positioned on the exterior of the conical section of the baffle, and this flange divides the annular chamber between the rear flat flange and the conical section of the baffle into two smaller chambers. The baffle may also be provided with gas cross-flow enhancement cuts. This may consist of a cut to the bore of a baffle on the proximal side of a baffle, where the bore hole of a baffle is modified by a cut that is positioned eccentrically to the axis of a baffle and where the cut consists of a portion of the baffle being removed from the bore. In this preferred embodiment, the cut may be positioned so that a portion of the rearward conical protrusion is removed. The conical section of the baffle may be provided with a gas cross-flow enhancement cut on the distal side of the baffle where the bore hole of this preferred embodiment is modified by a cut that is positioned eccentrically to the axis of the baffle. This cut consists of a portion of the baffle being removed from the bore or the cut is through or into the wall of the conical section of the baffle. If the cut on the distal side of the conical section of the baffle is such that it goes through the wall of the conical section, then the cut will extend into the annular chamber positioned between the flat flange, the outside surface of the conical section and the outside surface of the web.

In another preferred embodiment, the baffle is provided with a rear flat flange, and a conical section at the front and connected to the flat flange by a web or a parallel-sided tube. An annular chamber is provided between the rear flat flange and the conical section at the front of the baffle, and is defined by the front face of the rear flat flange, the outer surface of the conical section, the outer surface of the web and the inside diameter of the suppressor housing. The baffle may be provided with a rearward conical protrusion provided with multi-annular steps positioned concentrically on the rear flat flange with the multi-annular steps decreasing in diameter with respect to the distance from the rear flat flange. The multi-annular steps may also be provided with a tapered surface, whereby the tapered surface tapers inward from the outside diameter of each step and rearward towards the outside diameter of the next annular step as positioned with respect to the distance from the rear flat flange. The conical section of the baffle may be provided with a frontal turbulence generation structure that comprises an annular inward protruding lip, with the lip protruding inwards towards the axis of the baffle. The frontal turbulence generation structure may also be provided with at least one cut out, whereby a portion of the frontal turbulence generation structure is removed or there may be a plurality of cut outs in the structure. The annular inward protruding lip of the frontal turbulence generation structure may have a tapered surface on the proximal side of the lip or the surface may decrease in thickness with respect to the center axis of the baffle. The baffle may also be provided with gas cross-flow enhancement cuts. This may consist of a cut to the bore of a baffle on the proximal side of the baffle, where the borehole of the baffle is modified by a cut that is positioned eccentrically to the axis of the baffle and where the cut consists of a portion of the baffle being removed from the bore. In this preferred embodiment, the cut may be positioned so that a portion of the rearward conical protrusion is removed. The conical section of the baffle may be provided with a gas cross-flow enhancement cut on the distal side of the baffle where the bore hole of this preferred embodiment is modified by a cut that is positioned eccentrically to the axis of the baffle. This cut consists of a portion of the baffle being removed from the bore or the cut is through or into the wall of the conical section of the baffle. If the cut on the distal side of the conical section of the baffle is such that it goes through the wall of the conical section, then the cut will extend into the annular chamber positioned between the flat flange, the outside surface of the conical section and the outside surface of the web.

In yet another preferred embodiment, the baffle consists of a conical baffle that is provided with a plurality of annular steps positioned on the exterior of the conical baffle and positioned between the apex of the baffle and exit area of the conical baffle. The plurality of annular steps may also be provided with a tapered surface, whereby the tapered surface tapers inward from the outside diameter of each step and rearward towards the outside diameter of the next annular step as positioned with respect to the distance from the exit area of the conical baffle to the apex of the conical baffle. A flat flange with a diameter slightly less than the internal diameter of the suppressor housing may be positioned on the exterior of the conical section of the baffle. If this flange is used, then the plurality of annular steps may be positioned between the apex of the conical baffle and the flat flange. The conical baffle may be provided with a frontal turbulence generation structure that comprises an annular inward protruding lip, with the lip protruding inwards towards the axis of the baffles. The frontal turbulence generation structure may be positioned on the distal side of the conical baffle, or may be positioned within or on the inside of the conical baffle. The frontal turbulence generation structure may also be provided with at least one cut out, whereby a portion of the frontal turbulence generation structure is removed or there may be a plurality of cut outs in the structure. The annular inward protruding lip of the frontal turbulence generation structure may have a tapered surface on the proximal side of the lip or the surface may decrease in thickness with respect to the center axis of the baffle. The baffle may also be provided with gas cross-flow enhancement cuts. This may consist of a cut to the bore of a baffle on the proximal side of the baffle, where the bore hole of a baffle is modified by a cut that is positioned eccentrically to the axis of a baffle and where the cut consists of a portion of the baffle being removed from the bore. In this preferred embodiment, the cut may be positioned so that a portion of the conical baffle is removed. The conical baffle may be provided with a gas cross-flow enhancement cut on the distal side of the baffle where the borehole of this preferred embodiment is modified by a cut that is positioned eccentrically to the axis of the baffle. This cut may consist of a portion of the baffle being removed from the bore on the inside surface of the cone or the cut may be into the wall of the conical section of the baffle.

In yet another preferred embodiment, the baffle consists of a flat baffle that is provided with a rearward conical protrusion, and the rearward conical protrusion is positioned on the proximal side of the flat baffle. The rearward conical protrusion is provided with multi-annular steps positioned concentrically on the rearward conical protrusion with the multi-annular steps decreasing in diameter with respect to the distance from the rear face of the flat baffle. The multi-annular steps may also be provided with a tapered surface, whereby the tapered surface tapers inward from the outside diameter of the steps and rearward towards the outside diameter of the next annular step as positioned with respect to the distance from the rear flat face of the flat baffle. The baffle may also be provided with gas cross-flow enhancement cuts. This may consist of a cut to the bore of the baffle on the proximal side of the baffle, where the bore hole of the baffle is modified by a cut that is positioned eccentrically to the axis of a baffle and where the cut consists of a portion of the baffle being removed from the bore. In this preferred embodiment, the cut may be positioned so that a portion of the rearward conical protrusion is removed. The distal side of the baffle may be provided with a gas cross-flow enhancement cut where the bore hole of the preferred embodiment is modified by a cut that is positioned eccentrically to the axis of the baffle, and the cut may consist of a portion of the baffle being removed from the bore or the cut may be into the wall of the flat baffle.

Additional objects, advantages, and novel features of the invention will be set forth in part in the description as follows, and in part will become apparent to those skilled in the art upon examination of the following, or may be learned by practice of the invention.

Other objects and advantages of the present invention will become apparent to those skilled in the art from the following detailed descriptions given herein; it should be understood, however, that the detailed descriptions, while indicating preferred embodiments of the invention, are given by way of illustration only. Accordingly, the drawings and descriptions of the preferred embodiments are to be regarded as illustrative only, and not as restrictive.

BRIEF DESCRIPTION OF THE DRAWINGS

Referring particularly to the drawings for the purposes of illustration only, and not limitation.

DETAILED DESCRIPTION OF THE INVENTION

Figure 1:
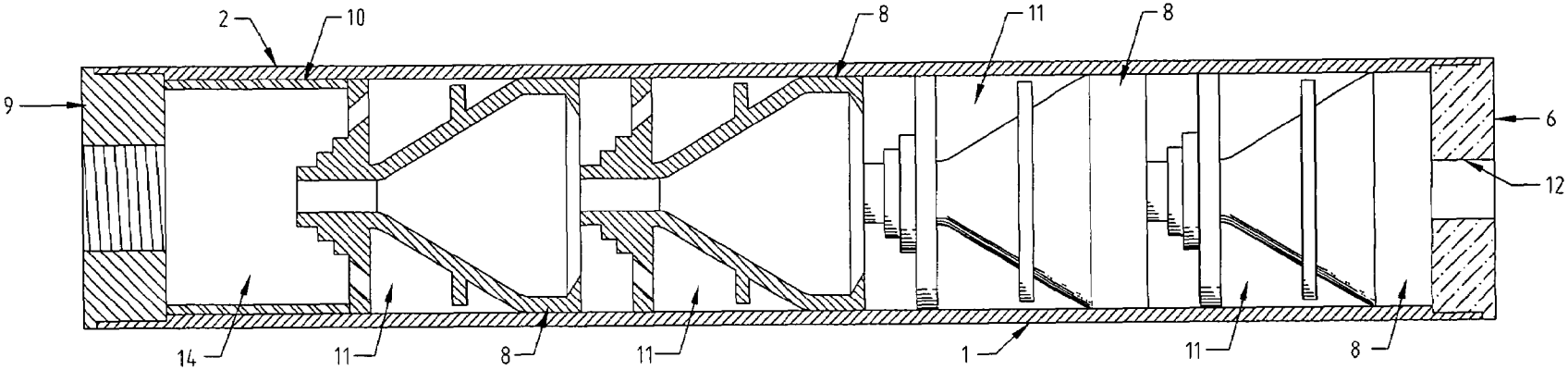
FIG. 1 shows a side sectional view of the housing and showing a combination of side sectional and side elevational views of the first preferred embodiment.

The preferred embodiments disclose a sound suppressor that utilizes baffles that use one or more of the disclosed features that enhance reduction of sound and flash, these features being a rearward conical protrusion provided with multi-annular steps, a flange with an external diameter slightly less than the internal diameter of the cylindrical housing, a frontal turbulence generation structure, at least one gas port positioned on the baffle, a frontal turbulence generation structure provided with at least one cut-out, and gas cross-flow enhancement cuts positioned on the proximal and distal sides of the baffles. The rearward conical protrusion provided with multi-annular steps may be positioned on the proximal face of a flat baffle or a baffle that uses a flat rear face as a part of the baffle structure or as a part of a conical baffle. The multi-annular steps may also be provided with a tapered section, whereby the tapered surface tapers inward from the outside diameter of each step and rearward towards the outside diameter of the next annular step. The flange with a diameter slightly less than the internal diameter of the suppressor housing may be positioned on the exterior surface of a conical baffle or a baffle that includes a conical section as part of the baffle. The frontal turbulence generation structure comprises an annular inward protruding lip, with the lip protruding inwards towards the axis of the suppressor, and is positioned on the distal side of a baffle. In the case of a conical baffle or a baffle that includes a conical section as part of the baffle, the frontal turbulence generation structure may also be positioned within the conical baffle or conical section of a baffle. The annular inward protruding lip of the frontal turbulence generation structure may have a tapered surface on the proximal side of the lip or the surface may decrease in thickness with respect to the center axis of the baffle. The frontal turbulence generation structure may be provided with at least one cut out, whereby a portion of the frontal turbulence generation structure is removed or there may be a plurality of cut outs in the structure. The baffle may also be provided with gas cross-flow enhancement cuts. This may consist of a cut to the bore of a baffle on the proximal side of a baffle, where the bore hole of a baffle is modified by a cut that is positioned eccentrically to the axis of a baffle and where the cut consists of a portion of the baffle being removed from the bore. Depending upon the embodiment, the cut may be positioned so that a portion of the rearward conical protrusion is removed. Depending upon the embodiment, the conical section of the baffle may be provided with a gas cross-flow enhancement cut on the distal side of the baffle where the bore hole of the baffle is modified by a cut that is positioned eccentrically to the axis of the baffle. This cut may consist of a portion of the baffle being removed from the bore and the cut may extend through the wall or into the wall of the conical section of the baffle.

FIG. 1 is a view of a sound suppressor for a firearm showing the housing in side sectional view and a combination of side sectional and side elevational views of the first preferred embodiment. The sound suppressor 1 comprises a cylindrical housing 2, a proximal end cap 4 with means for attachment to a firearm and to the cylindrical housing, a distal end cap 6 with means for attachment to the housing, and a plurality of baffles 8 positioned within the housing and between the proximal end and distal end caps of the suppressor. A separate cylindrical spacer element 10 is positioned between the proximal 4 end of the suppressor and the first of the baffles 8. This spacer provides axial positioning of the baffles within the cylindrical housing of the suppressor. The distal end cap 6 of the suppressor is provided with a concentric circular hole or aperture 12 for the projectile to pass through the end of the suppressor. An expansion chamber 14 is formed between the proximal end cap and the first of the baffles 8.

FIGS. 2, 3, 4, 5 and 5*a* show details of the first preferred embodiment. In this preferred embodiment, baffle 8 comprises a rear flat flange 3 and a conical section 5 at the front with these two sections connected together by a web 7 or parallel-sided tube. The baffle 8 is provided with an aperture or bore hole 9 for passage of projectiles. An annular chamber 11 is positioned between the rear flat flange 3 and the conical section 5 at the front of the baffle. This annular chamber is defined by the front face 13 of the rear flat flange 3, the outer surface 15 of the conical section 5, the outer surface 17 of the web or parallel sided tube 7 and the inside diameter of the suppressor housing when the baffles are positioned within the suppressor housing. A flat flange 19 with a diameter slightly less than the internal diameter of the suppressor housing is positioned on the outer surface 15 of the conical section of the baffle, and this flange divides the annular chamber 11 between the rear flat flange and the conical section of the baffle into two smaller chambers that are co-joined by the gap between the outer diameter of the flat flange 19 and the inner diameter of the housing. At least two gas ports 21 that are angled with respect to the axis of the baffles are positioned in the rear flat flange. These 2 gas ports 21 vent high pressure gases into the annular chamber 11 that is positioned between the flat flange 3 and the conical section 5 of the baffle. On the proximal side of the baffle, there is a rearward conical protrusion 23 provided with multi-annular steps 25 positioned concentrically on the rear flat flange 3 with the multi-annular steps 25 decreasing in diameter with respect to the distance from the rear flat flange 3. The multi-annular steps may have a flat surface or they may have a tapered surface.

A frontal turbulence generation structure 27 that comprises an annular inward protruding lip 29, with the lip protruding inwards towards the axis of the baffles, is positioned at the distal end of the conical section of the baffle. The annular inward protruding lip 29 of the frontal turbulence generation structure may have a tapered surface 31 on the proximal side of the lip or the surface may decrease in thickness with respect to the center axis of the baffle. To enhance the generation of turbulence, the structure may be positioned slightly forward of the exit area of the conical section of the baffle, and this is achieved by the use of a short spacer ring 33 that is positioned between the exit area of the baffle and the frontal turbulence generation structure 27. The frontal turbulence generation structure 27 may be provided with at least one cut out 35 (not shown) whereby a portion of the frontal turbulence generation structure is removed or there may be a plurality of cut outs in the structure as shown in FIG. 10*a*. These cut outs may be in the shape of a half-circle, a chevron, or any geometrical shape. It will be obvious to those skilled in the art that the size, number and shape of the cut outs is dependent upon the caliber and type of firearm used with the suppressor. It should be realized that the cut out shape shown in the drawings is for illustrative purposes only, and should not be considered as restrictive.

Figure 2:
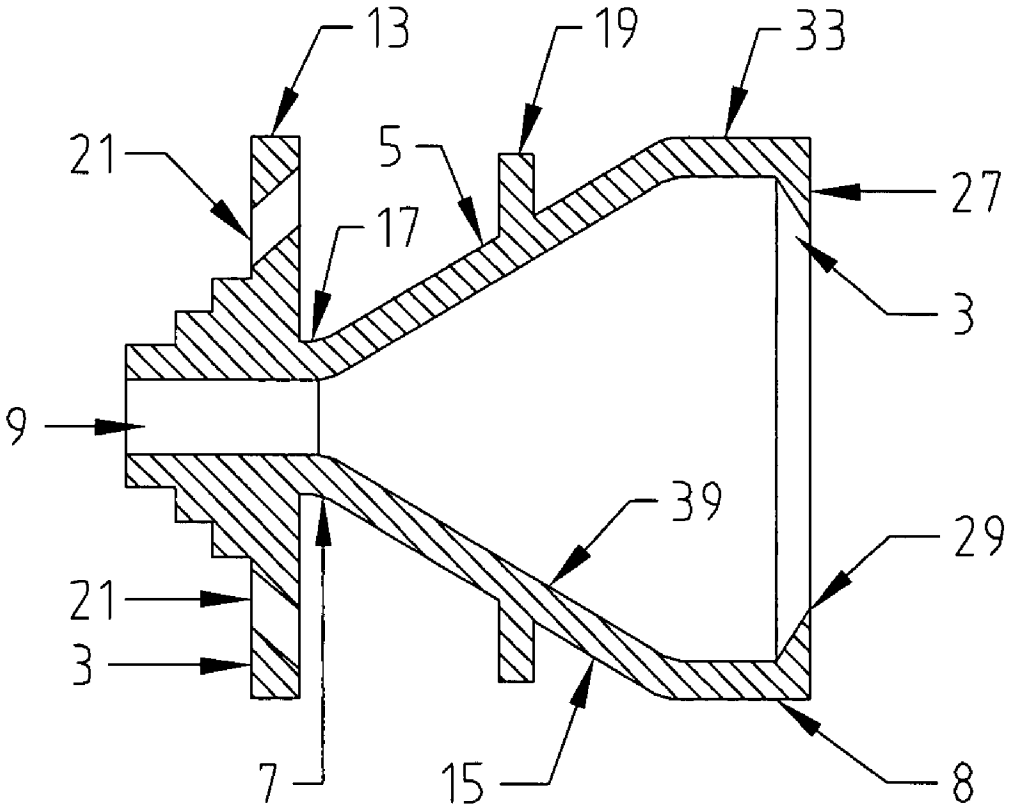
FIG. 2 is a side sectional view of the first preferred embodiment.
Figure 3:
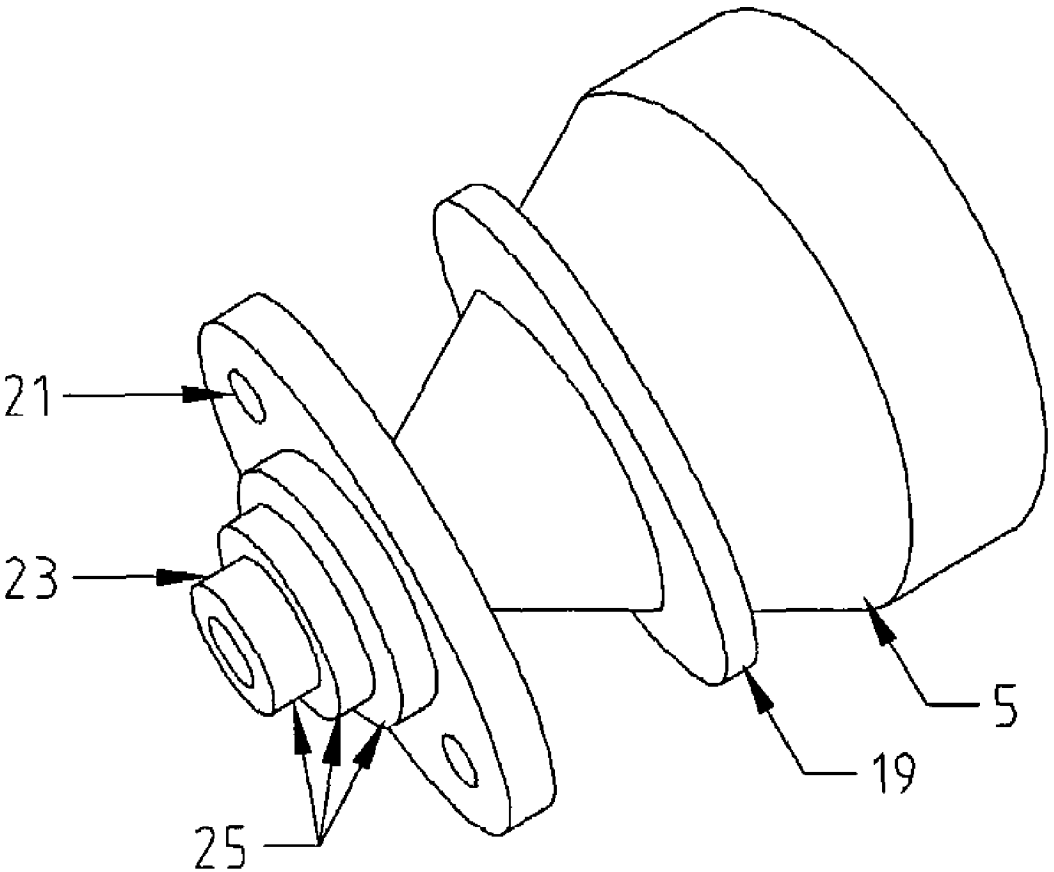
FIG. 3 is a front face perspective view of the first preferred embodiment.
Figure 4:
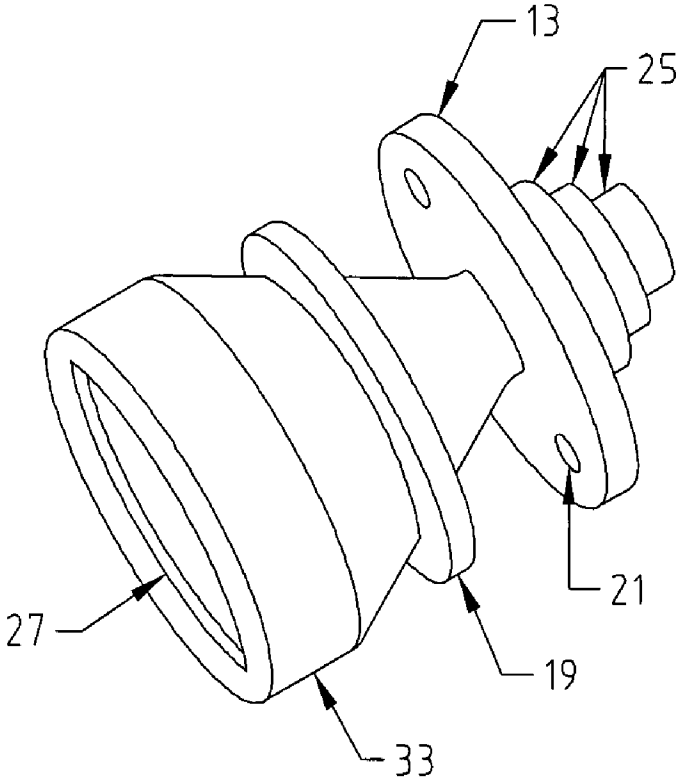
FIG. 4 is a rear face perspective view of the first preferred embodiment.
Figure 7:
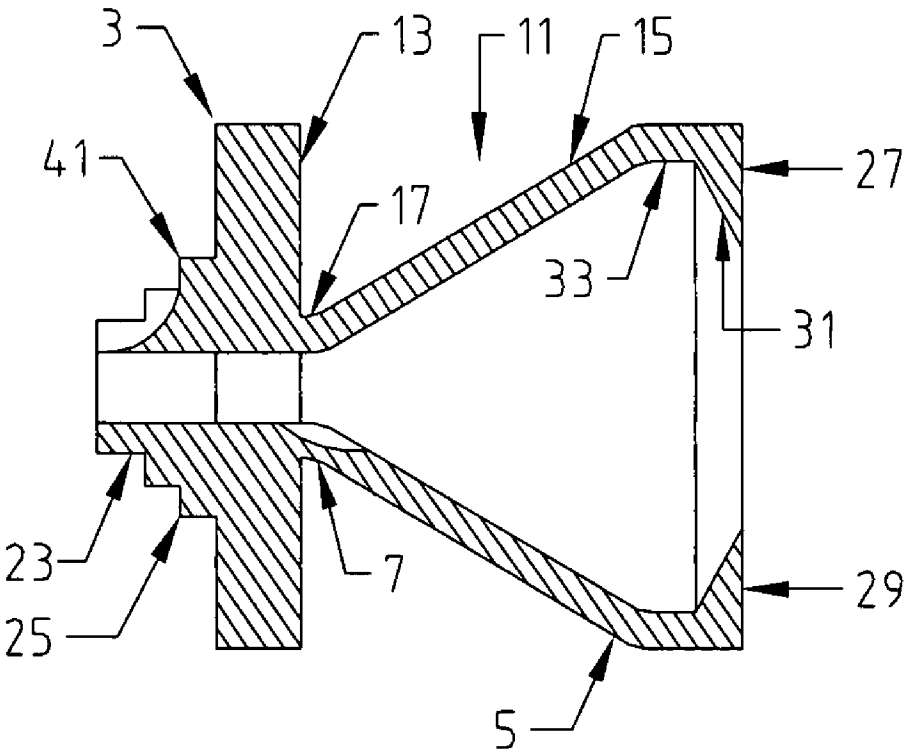
FIG. 7 is a side sectional view of the second preferred embodiment.
Figure 8:
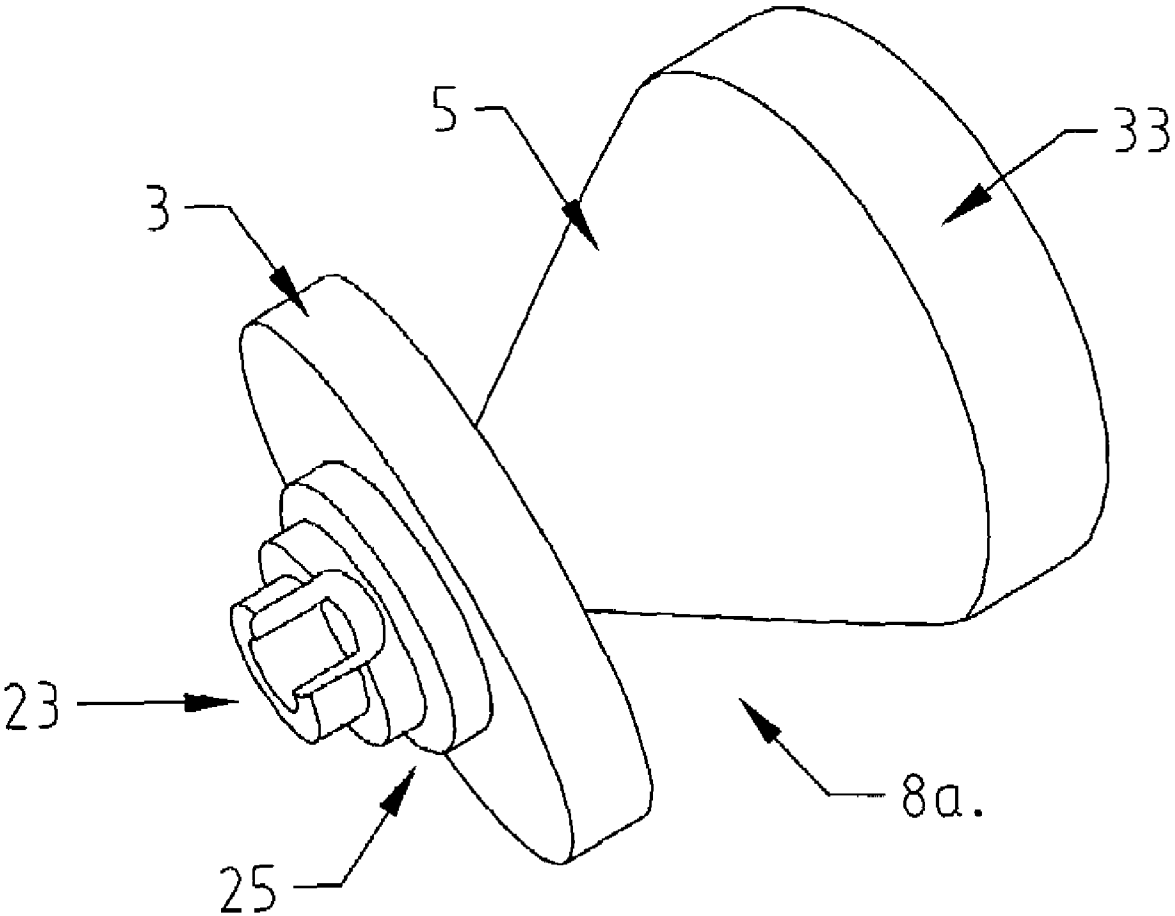
FIG. 8 is a front face perspective view of the second preferred embodiment.
Figure 9:
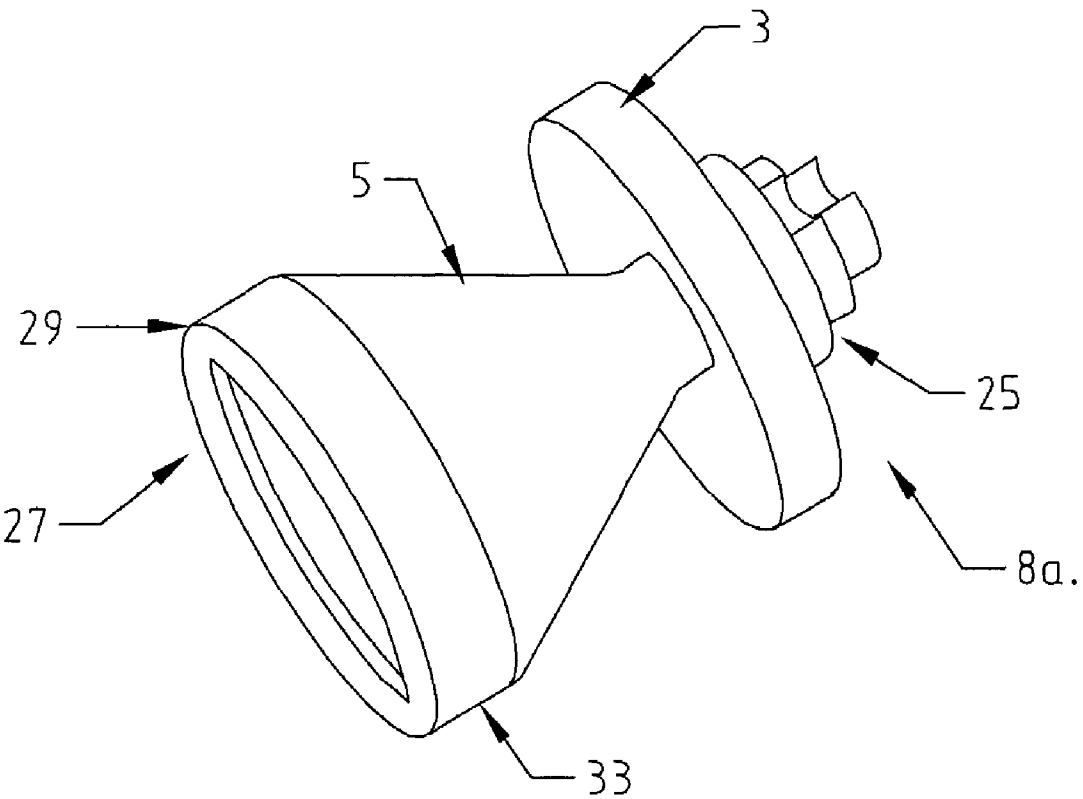
FIG. 9 is a rear face perspective view of the second preferred embodiment.

Although not shown in FIGS. 1, 2 and 3, the baffle 8 may be provided with gas cross-flow enhancement cuts 37 as shown in FIGS. 7, 8, and 9. On the proximal side of the baffle, the borehole 9 of the baffle is modified by a cut 37. This cut is positioned eccentrically to the axis of the baffle, and consists of a portion of the baffle being removed from the bore. As the rear face of the baffle has the rearward conical protrusion, this means that the cut results in a portion of the rearward conical protrusion being removed. On the distal side of the baffle, the conical section 5 of the baffle 8 is modified by a cut 37 to the bore that is positioned eccentrically to the axis of the baffle. Depending upon the caliber and type of firearm to be used with the suppressor, the cut may consist of a portion of the baffle being removed from the bore with the cut extending only into the wall 39 of the conical section. Other applications may require the cut to go through the wall 39 of the conical section of the baffle. If the cut goes through the wall of the conical section, then the cut will extend into the annular chamber 11 positioned between the flat flange 3 and the conical section 5.

Figure 5:
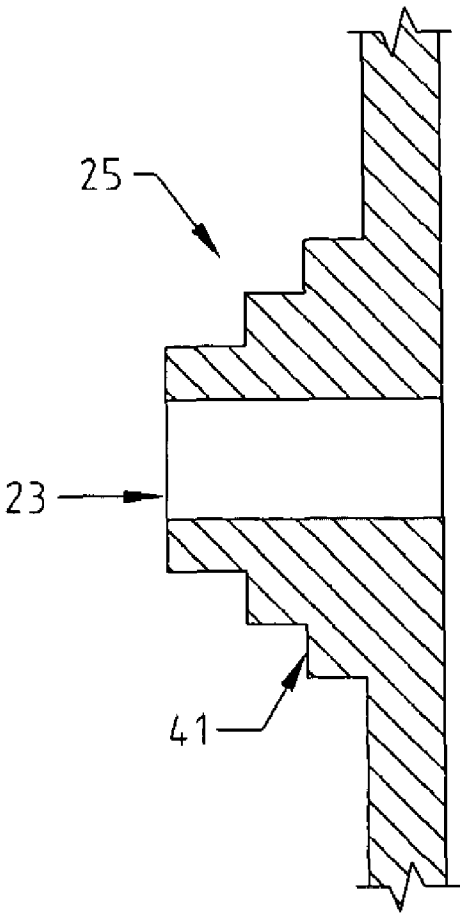
FIGS. 5 and 5*a* are enlarged sectional views of the preferred and alternate embodiments of the rearward conical protrusion with multi-annular steps showing the flat and tapered front surfaces of the multi-annular steps.
Figure 5A:
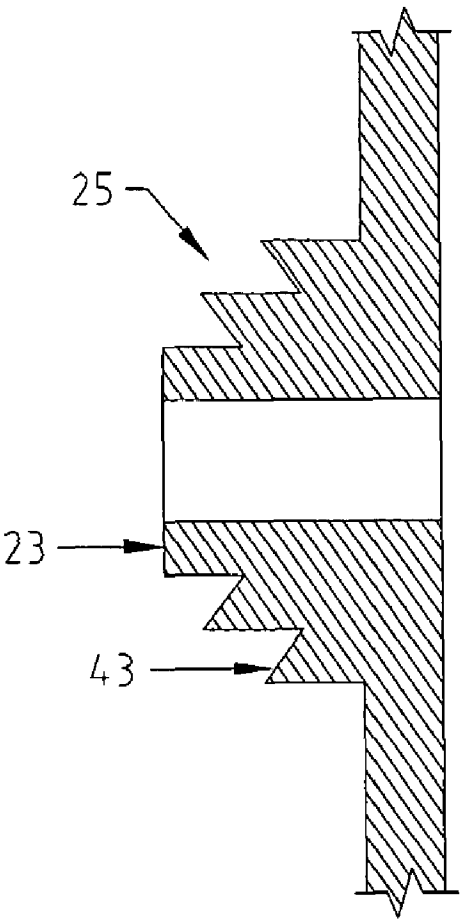

FIGS. 5 and 5*a* show an enlarged sectional view of the preferred and alternate embodiments of the rearward conical protrusion 23 with multi-annular steps 25. Depending upon the caliber and type of firearm that the suppressor is designed for and used, these multi-annular steps 25 may have a flat front surface 41 or they may have a tapered front surface 43. In the alternate embodiment of this feature, the multi-annular steps have a tapered front surface 43, whereby the tapered surface tapers inward from the outside diameter of each step and rearward towards the outside diameter of the next annular step as positioned with respect to the distance from the rear flat flange.

Figure 6:
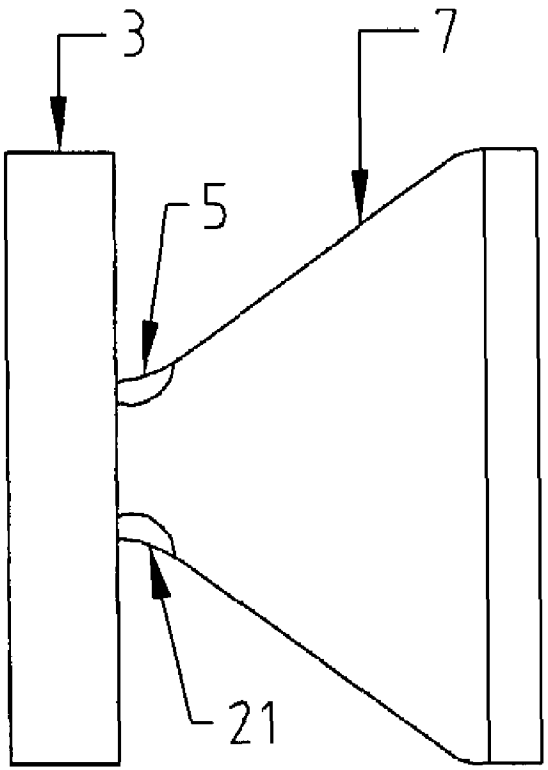
FIGS. 6 and 6*a* are side elevational and side sectional views of the prior art.
Figure 6A:
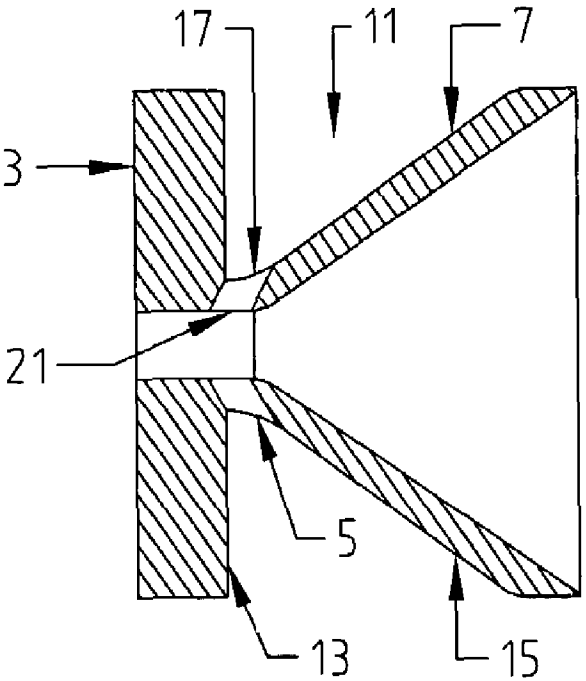

FIGS. 6 and 6*a* show the prior art 'K' baffle in side elevational and side sectional views where the baffle consisted of a flat flange 3 joined to a conical section 5 by a web or parallel sided tube 7. An annular chamber 11 was formed between the front face 13 of the flat flange 3, the outer surface 15 of the conical section 5, the outer surface 17 of the web 7 and the inside diameter of a suppressor housing when the baffle is positioned within a suppressor housing. This shows the original embodiment of the 'K' baffle where gas vent ports 21 were positioned within the web section of the baffle and these gas vent ports vented gas from the borehole of the baffle into the chamber between the flat flange and the conical section. While the 'K' baffle, as shown here or with slanted sidewalls or asymmetric cuts or scoops on the proximal and distal sides of the baffle, performed well, it has been found that the use of the disclosed features with the 'K' baffle considerably enhances the performance of this baffle. Those skilled in the art will appreciate that the use of these features is dependent upon the caliber and type of firearm used with the suppressor.

FIGS. 7, 8, and 9 show the second preferred embodiment in a side sectional, front face perspective and rear face perspective views respectively. The second preferred embodiment utilizes a baffle 8*a* where the baffle is provided with a rear flat flange 3, and a conical section 5 at the front and connected to the flat flange by a web or parallel-sided tube 7. An annular chamber 11 is provided between the rear flat flange 3 and the conical section 5 at the front of the baffle, and is defined by the front face 13 of the rear flat flange 3, the outer surface 15 of the conical section, the outer surface 17 of the web and the inside diameter of the suppressor housing when the baffle is positioned within the suppressor housing. The baffle 8*a* is provided with a rearward conical protrusion 23 provided with multi-annular steps 25 positioned concentrically on the rear flat flange 3 with the multi-annular steps decreasing in diameter with respect to the distance from the rear flat flange. Depending upon the caliber and type of firearm that the suppressor is designed for and used, these multi-annular steps 25 may have a flat front surface 41 or they may have a tapered front surface 43 as shown in FIG. 5*a*. In the alternate embodiment of this feature, the multi-annular steps have a tapered front surface 43, whereby the tapered surface tapers inward from the outside diameter of each step and rearward towards the outside diameter of the next annular step as positioned with respect to the distance from the rear flat flange.

A frontal turbulence generation structure 27 that comprises an annular inward protruding lip 29, with the lip protruding inwards towards the axis of the baffles, is positioned at the distal end of the conical section of the baffle. The annular inward protruding lip 29 of the frontal turbulence generation structure 27 may have a tapered surface 31 on the proximal side of the lip or the surface may decrease in thickness with respect to the center axis of the baffle. To enhance the generation of turbulence, the structure may be positioned slightly forward of the exit area of the conical section of the baffle, and this is achieved by the use of a short spacer ring 33 that is positioned between the exit area of the baffle and the frontal turbulence generation structure 27. The frontal turbulence generation structure may be provided with at least one cut out 35 (not shown) whereby a portion of the frontal turbulence generation structure is removed or there may be a plurality of cut outs 35 in the structure as shown in FIG. 10*a*.

The baffle 8*a* is provided with gas cross-flow enhancement cuts 37. On the proximal side of the baffle, the borehole 9 of the baffle is modified by a cut 37. This cut is positioned eccentrically to the axis of the baffle, and consists of a portion of the baffle being removed from the bore. As the rear face of the baffle has the rearward conical protrusion, this means that the cut results in a portion of the rearward conical protrusion being removed. On the distal side of the baffle, the conical section 5 of the baffle 8*a* is modified by a cut 37 to the bore that is positioned eccentrically to the axis of the baffle. Depending upon the caliber and type of firearm to be used with the suppressor, the cut may consist of a portion of the baffle being removed from the bore with the cut extending only into the wall 39 of the conical section. Other applications may require the cut to go through the wall 39 of the conical section of the baffle. If the cut goes through the wall of the conical section, then the cut will extend into the annular chamber 11 positioned between the flat flange 3 and the conical section 5.

Figure 10:
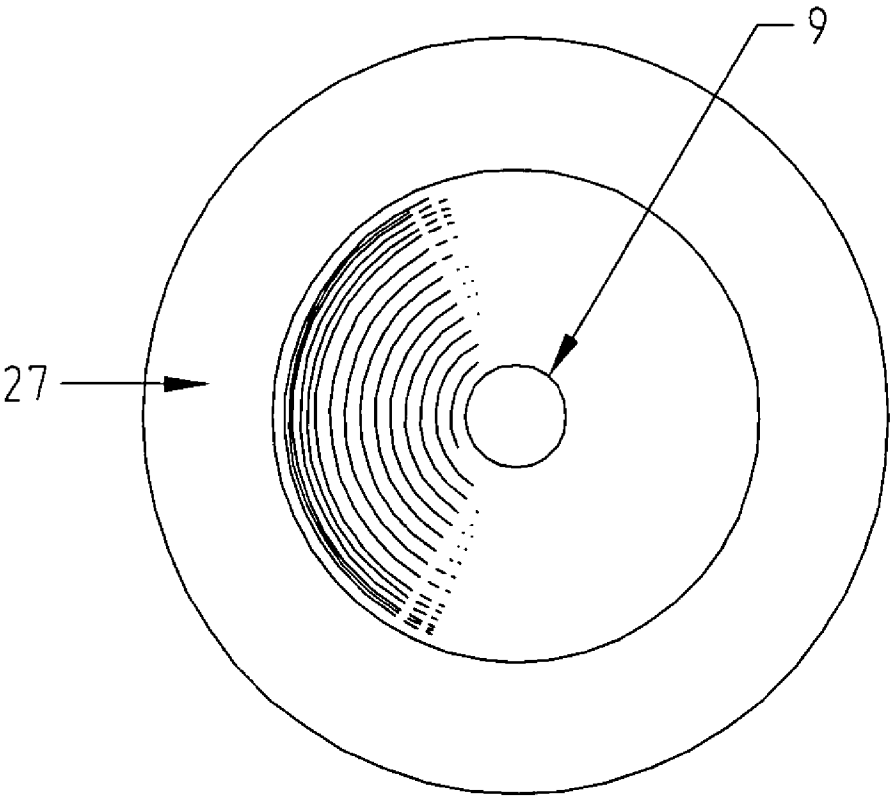
FIGS. 10 and 10*a* are front face views of second preferred embodiment showing the front view of the frontal turbulence generator structure with and without cutouts in the structure.
Figure 10A:
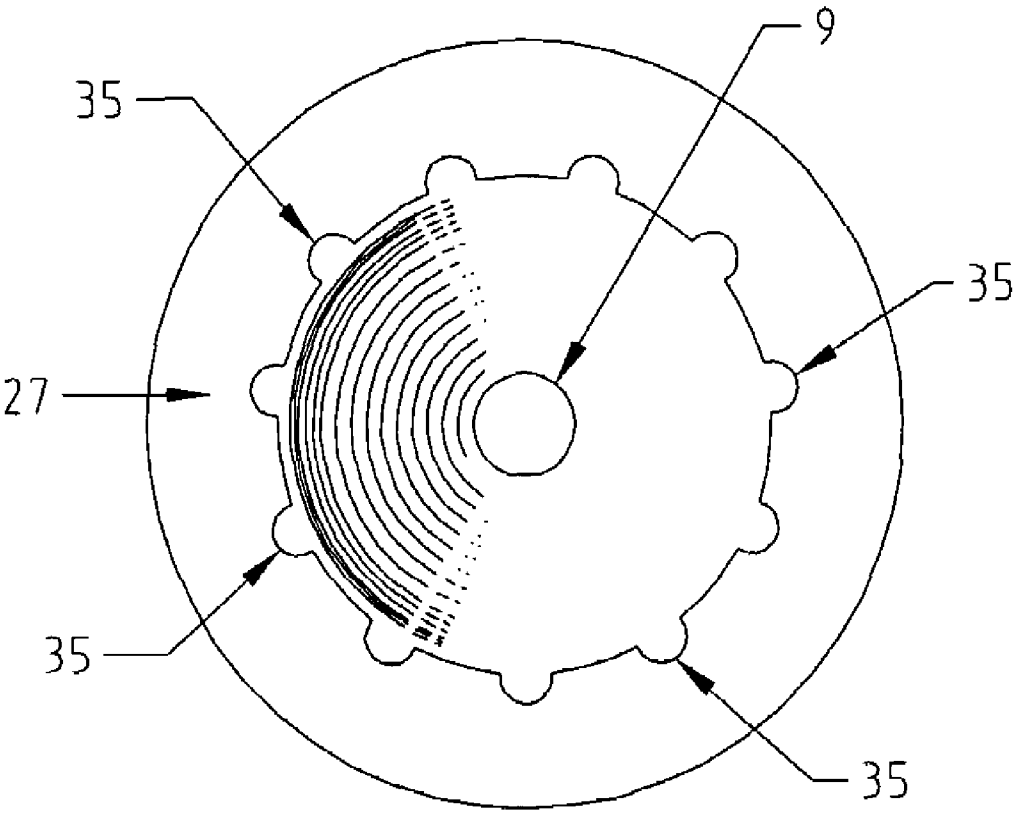

FIGS. 10 and 10*a* show a front face view of the distal end of the second embodiment 8*a*. The frontal turbulence generation structure 27 is shown with and without cutouts 35 and it should be realized that the size, number and position of these cutouts will, to those skilled in the art, be subject to the caliber and type of firearm used with the suppressor and the size of the suppressor. It should be noted that, for purposes of clarity, the gas cross-flow enhancement cut 37 is not shown in FIGS. 10 and 10*a*.

Figure 11:
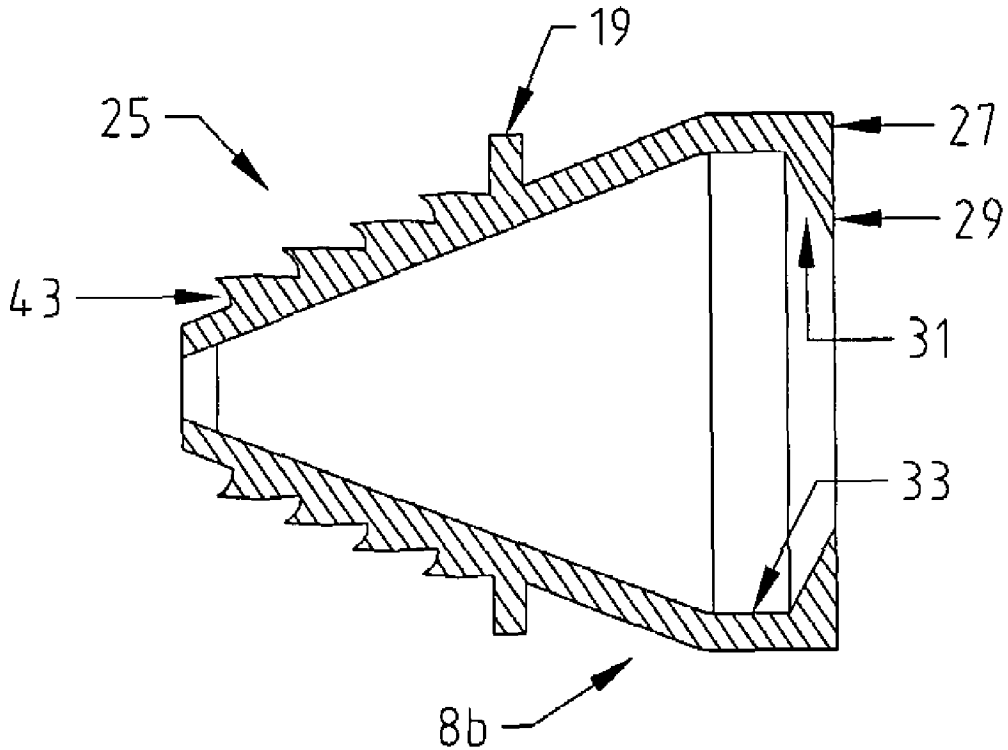
FIGS. 11 and 11*a* are side sectional views of the third preferred embodiment and an alternate embodiment.
Figure 11A:
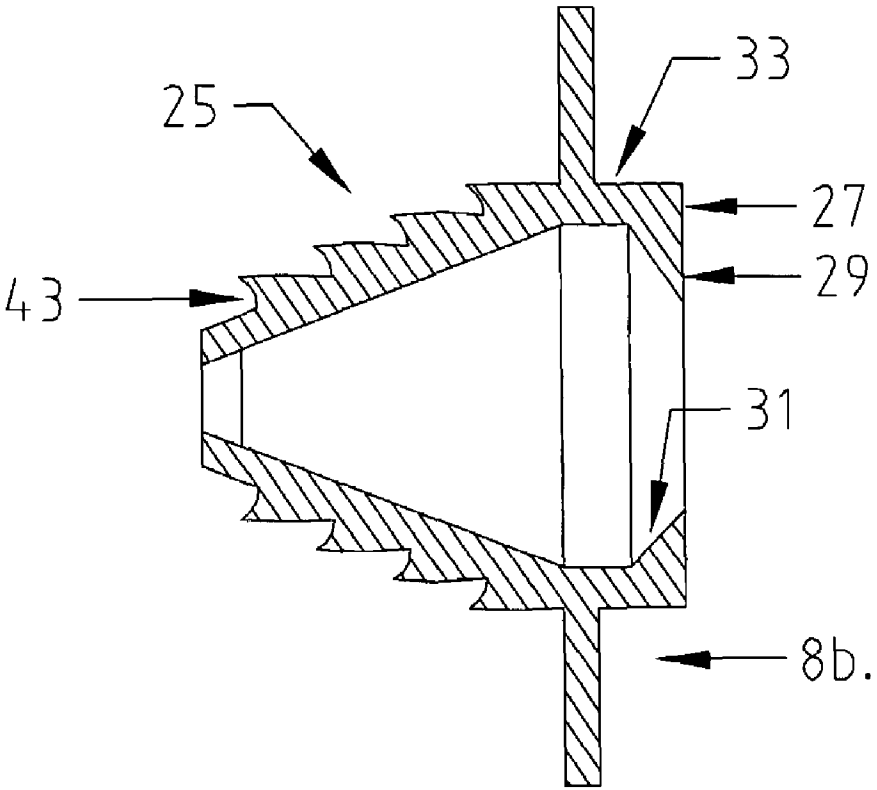

It has been found that the features disclosed in the first and second embodiments may also be used with other baffle structures, such as the generic flat and conical baffles, and the use of these features enhances the performance of these generic baffles. FIGS. The third preferred embodiment discloses a conical baffle 8*b*. The conical baffle 8*b* may be a conical baffle where the exit diameter of the baffle is close to the internal diameter of the suppressor housing, and such conical baffles are quite common in both the prior and the practiced art, or the conical baffle may have an exit diameter of the baffle that is significantly less than the internal diameter of the suppressor housing, and such conical baffles are also quite common in both the prior and the practiced art, as shown in FIGS. 11 and 11*a*. FIGS. 11 and 11*a*, 12 and 12*a*, 13, 14, and 15 show the third preferred embodiment. FIGS. 11 and 11*a* show the two common forms of the conical baffle with the disclosed features. In these embodiments, the conical baffles 8*b* and 8*b*' are provided with a plurality of annular steps 25 positioned on the exterior of the conical baffles. These annular steps are positioned between the apex of the baffle and exit area of the conical baffle. These annular steps 25 have a tapered front surface 43, and the tapered surface tapers inward from the outside diameter of each step and rearward towards the outside diameter of the next annular step as positioned with respect to the distance from the exit area of the conical baffle to the apex of the conical baffle. Depending upon the application, a flat flange 19 with a diameter slightly less than the internal diameter of the suppressor housing may be positioned on the exterior of the conical section of the baffle. If this flange is used, then the plurality of annular steps may be positioned between the apex of the conical baffle and the flat flange.

Figure 12:
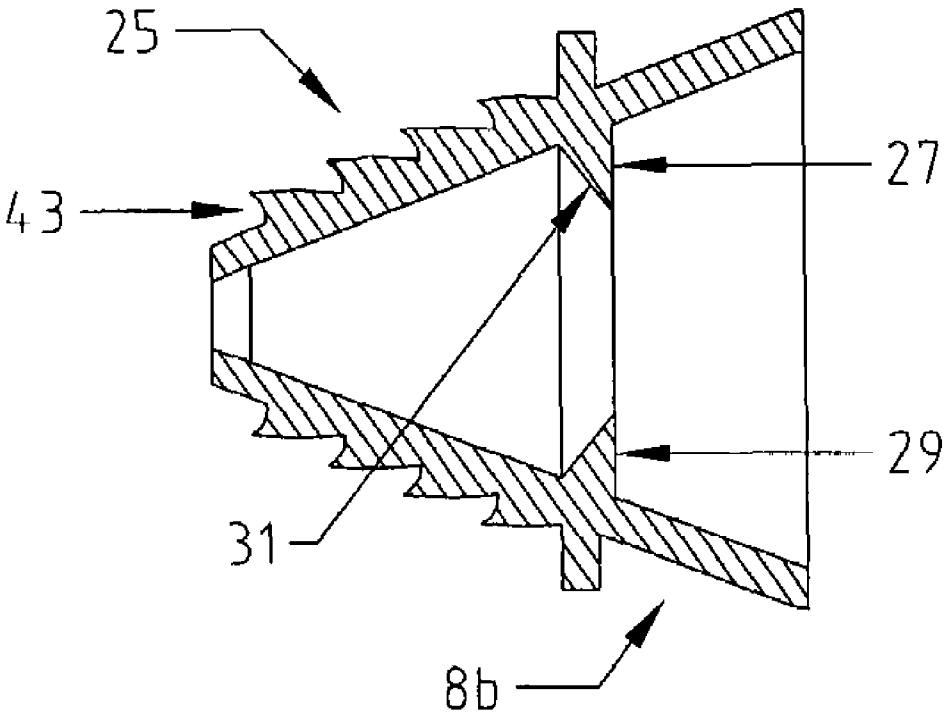
FIGS. 12 and 12*a* are side sectional views of the third preferred embodiment and an alternate embodiment showing the turbulence generation structures positioned on the interior of the conical baffle and at the exit area of the conical baffle.
Figure 12A:
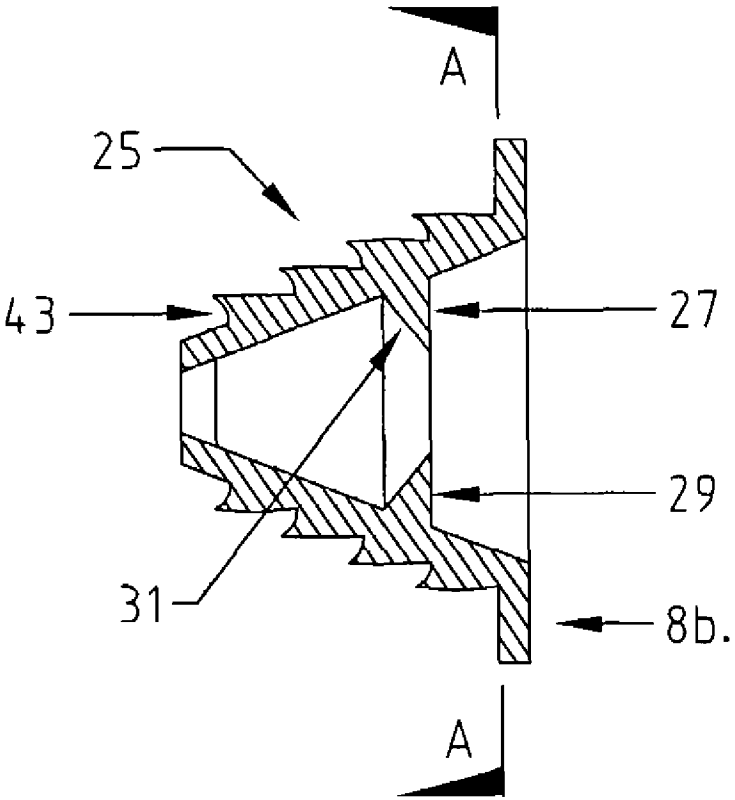
Figure 13:
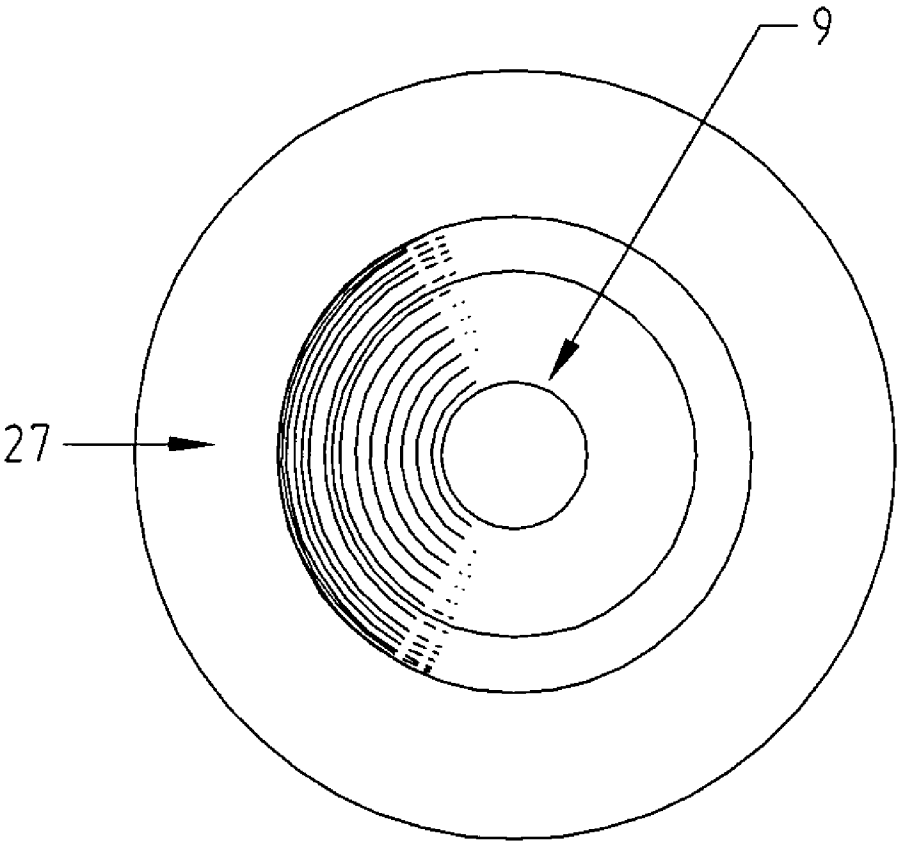
FIG. 13 is a front face view taken along line A-A shown in FIG. 12*a*.
Figure 14:
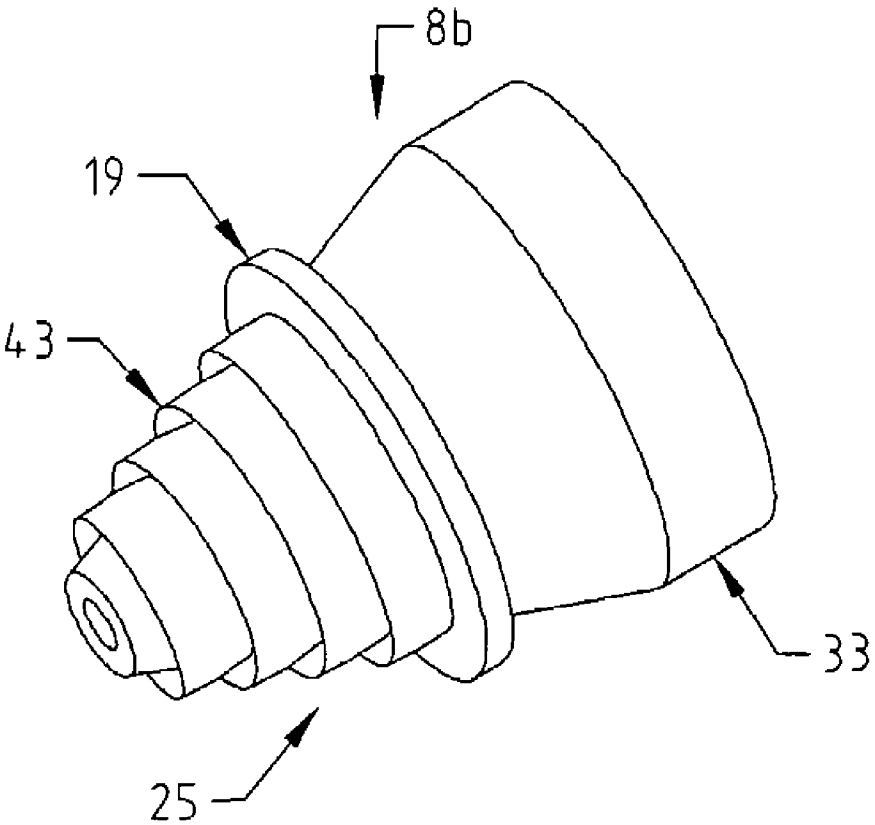
FIG. 14 is a front face perspective view of the third preferred embodiment.
Figure 15:
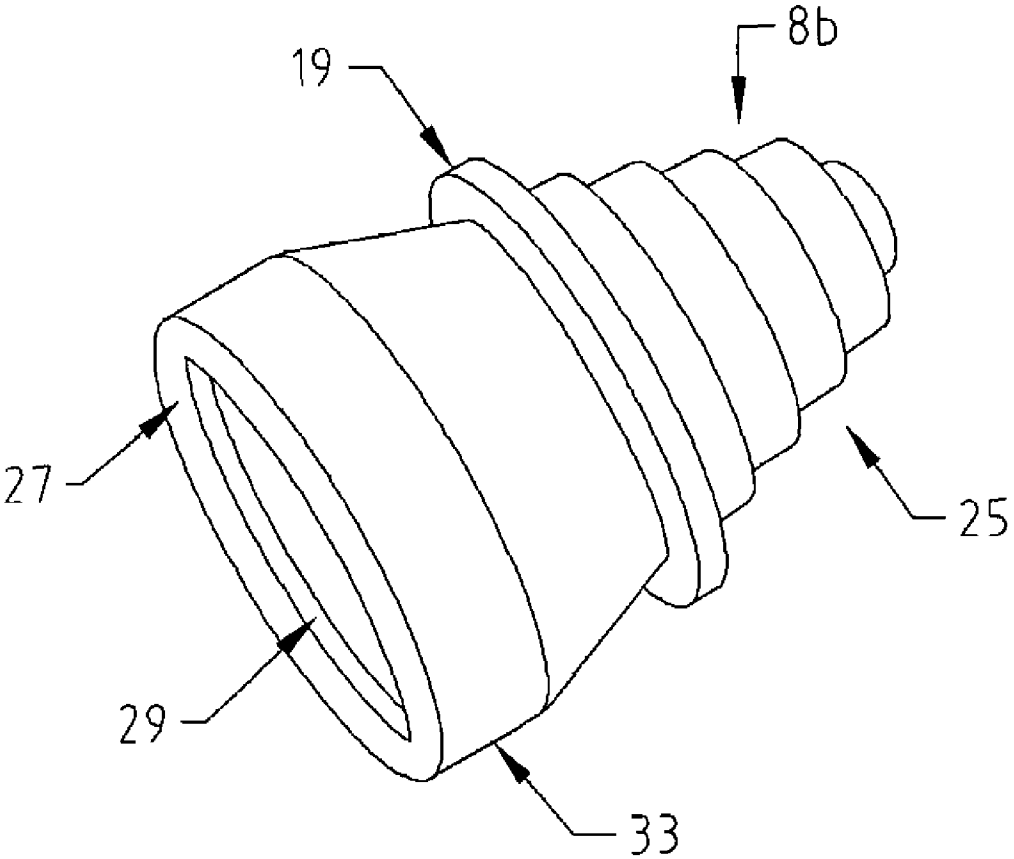
FIG. 15 is a rear face perspective view of the third preferred embodiment.

At the distal end of the conical baffles 8*b* and 8*b*', a frontal turbulence generation structure 27 is positioned. This structure comprises an annular inward protruding lip 29, with the lip protruding inwards towards the axis of the baffle 8*b*. The annular inward protruding lip 29 of the frontal turbulence generation structure 27 may have a tapered surface 31 on the proximal side of the lip or the surface may decrease in thickness with respect to the center axis of the baffle. To enhance the generation of turbulence, the structure 27 may be positioned slightly forward of the exit area of the conical section of the baffle, and this is achieved by the use of a short spacer ring 33 that is positioned between the exit area of the conical baffle and the frontal turbulence generation structure. This short spacer ring 33 has an inside diameter that is the same as the diameter of the exit area of the conical baffle, and this short spacer ring is integral with the conical baffle and the frontal turbulence generation structure. FIG. 11 and 11*a* show that, regardless of the diameter of the exit area of the conical baffle being close to the internal diameter of the suppressor housing, like that of baffle 8*b*, or the diameter of the exit area being significantly less than the internal diameter of the suppressor housing, like that of baffle 8*b*', the short spacer ring 33 is integral with the conical baffle and the frontal turbulence generation structure. The frontal turbulence generation structure 27 may be provided with at least one cut out 35 (not shown), whereby a portion of the frontal turbulence generation structure is removed or there may be a plurality of cut outs in the structure as shown in FIG. 10*a*. It has been found that the frontal turbulence generation structure 27 may be positioned within or on the inside of the conical baffle, as shown in FIG. 12*a*, and such positioning, with the structure having a plurality of cut outs 35, coupled with the use of a short spacer ring 33 and a frontal turbulence generation structure 27 at the exit area of the conical baffle, this also having a plurality of cut outs 35, considerably enhances the generation of turbulence within the conical baffle and at the exit area of the conical baffle.

Gas cross-flow enhancement cuts 37 may be used with the third preferred embodiment, though they are not shown in FIGS. 11 and 11*a*, 12 and 12*a*, 13, 14, and 15. This may consist of a cut 37 to the bore of the conical baffle on the proximal side of the baffle, and the borehole of the baffle is modified by a cut that is positioned eccentrically to the axis of the baffle. The cut in this embodiment consists of a portion of the baffle being removed from the baffle borehole. On the distal side of the conical baffle, a gas cross-flow enhancement cut 37 is positioned eccentrically to the axis of the baffle. Depending upon the firearm to be used with the suppressor, this cut on the distal side may consist of a portion of the baffle being removed from the bore on the inside surface of the cone or the cut may be into or through the wall 39 of the conical section of the baffle. If the gas cross-flow enhancement cut 37 is through the wall 39 of the conical baffle, then this will act also as a gas vent port, venting high-pressure gases from the interior of the conical baffle 8*b* to the exterior of the conical baffle.

Figure 16:
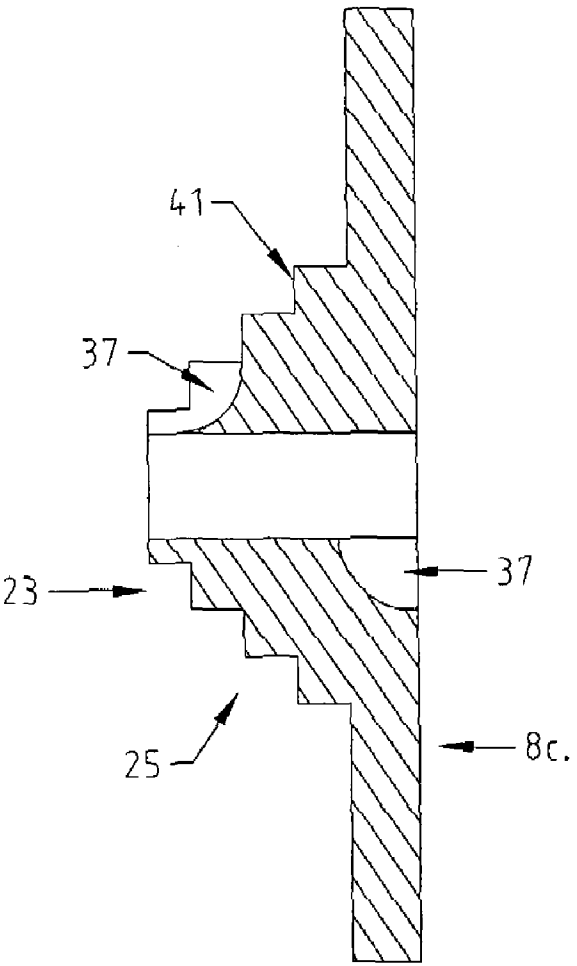
FIG. 16 is a side sectional view of the fourth preferred embodiment.
Figure 17:
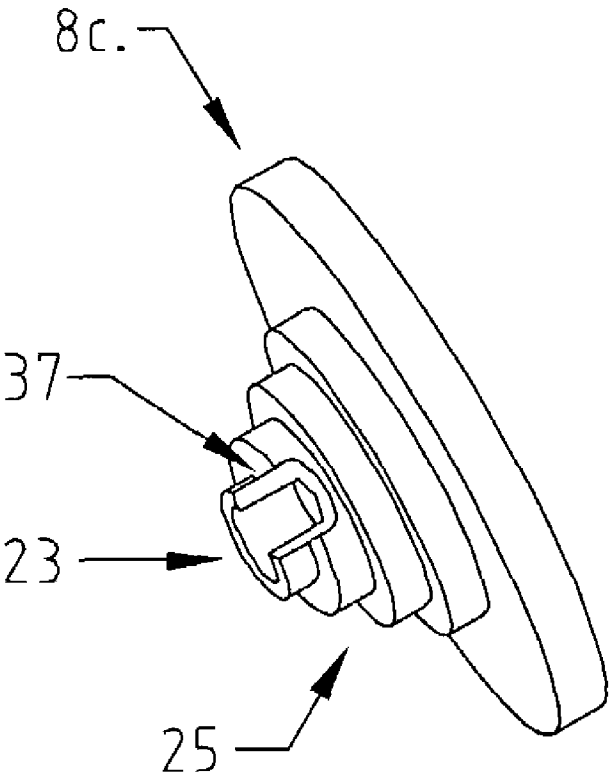
FIG. 17 is a front face perspective view of the fourth preferred embodiment
Figure 18:
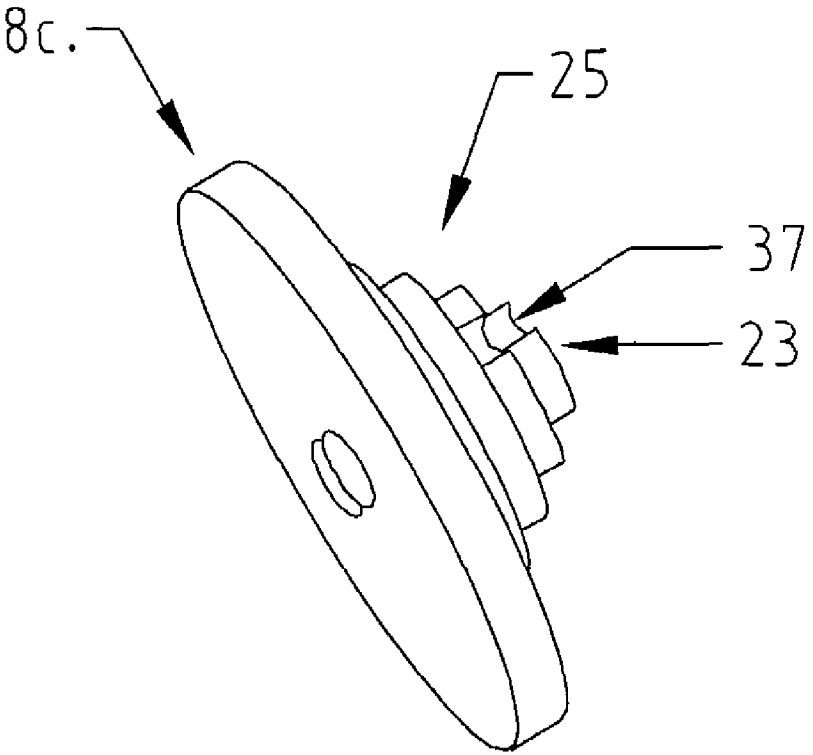
FIG. 18 is a rear face perspective view of the fourth preferred embodiment.

FIGS. 16, 17 and 18 show the fourth preferred embodiment in side sectional, front face perspective and rear face perspective views respectively. The baffle 8*c* consists of a flat or nearly flat baffle, and on the proximal side of the baffle, there is a rearward conical protrusion 23. The rearward conical protrusion is provided with multi-annular steps 25 positioned concentrically on the rearward conical protrusion with the multi-annular steps decreasing in diameter with respect to the distance from the rear face of the baffle. Depending upon the caliber and type of firearm that the suppressor is designed for and used, these multi-annular steps 25 may have a flat front surface 41 or they may have a tapered front surface 43. In the alternate embodiment of this feature, the multi-annular steps have a tapered front surface 43, as shown in FIG. 5*a* whereby the tapered surface tapers inward from the outside diameter of each step and rearward towards the outside diameter of the next annular step as positioned with respect to the distance from the rear flat flange.

The baffle 8*c* may also be provided with gas cross-flow enhancement cuts 37. On the proximal side of a baffle, the bore hole of the baffle may be modified by a cut 37. This cut is positioned eccentrically to the axis of the baffle, and consists of a portion of the baffle being removed from the bore. As the rear face of the baffle has the rearward conical protrusion, this means that the cut results in a portion of the rearward conical protrusion being removed. On the distal side of the baffle, the gas flow enhancement cut 37 consists of a cut that is positioned eccentrically to the bore of the baffle, and may be a cut to the bore so that a portion of the baffle is removed at the bore or the cut may be into the wall of the flat baffle.

While the invention has been described in a number of specific embodiments for purposes of explanation and illustration, it will be obvious that numerous variations, modifications and substitutions will be readily apparent to those skilled in the art without departing from the spirit and scope of the invention. Accordingly, it is not intended to limit the invention to the precise forms and descriptions detailed, and it is intended that the invention be defined by the following claims.

The invention claimed is:

1. A sound suppressor for a firearm, comprising:

a cylindrical housing, a proximal rear end cap whereby said proximal rear end cap has means for attachment to said cylindrical housing and has means for attachment to the muzzle of a firearm, a distal front end cap whereby said distal front end cap has means for attachment to said cylindrical housing and has an aperture for passage of projectiles, at least one baffle element, and at least one spacer element positioned within said housing, and an expansion chamber, said expansion chamber positioned between the proximal rear end cap and said baffle element, whereby said baffle element comprises a baffle with a central bore and including at least two of said following features, said features being:

a rearward conical protrusion provided with a plurality of annular steps, said protrusion positioned on the proximal side of the baffle element, said plurality of annular steps positioned concentrically on the rearward conical protrusion, said steps having a flat front surface, and said plurality of annular steps decreasing in diameter with respect to the distance from the proximal side of the baffle element;

a rearward conical protrusion provided with a plurality of annular steps, said protrusion positioned on the proximal side of the baffle element, said plurality of annular steps positioned concentrically on the rearward conical protrusion, said plurality of annular steps decreasing in diameter with respect to the distance from the proximal side of the baffle element, whereby said plurality of annular steps on said rearward conical protrusion have a tapered front surface, said tapered surface tapering inward from the outside diameter of each step and rearward towards the outside diameter of the next annular step as positioned with respect to the distance from the proximal side of said baffle;

a flange that is positioned on the proximal side of the baffle element, and whereby said flange is has a diameter that is slightly less than the internal diameter of said housing;

at least two gas ports that are angled with respect to the axis of the baffles, said gas ports being positioned on the proximal side of the baffle element;

gas cross-flow enhancement cuts to the bore of the baffle element, whereby said cuts are positioned eccentrically to the bore axis of the baffle, and whereby said cuts are positioned on the proximal and distal sides of the baffle;

a frontal turbulence generation structure that is positioned on the distal side of the baffle element, and whereby said structure comprises an annular inward protruding lip, said lip protruding inwards towards the axis of the suppressor, said lip having a rear surface that decreases in thickness with respect to the center axis of the baffle element, said frontal turbulence generation structure being an integral part of said baffle element;

a frontal turbulence generation structure that is positioned on the distal side of the baffle element, and whereby said structure comprises an annular inward protruding lip, said lip protruding inwards towards the axis of the suppressor, said lip having a rear surface that decreases in thickness with respect to the center axis of the baffle element and whereby said frontal turbulence generation structure has at least one geometrical shaped cut, said cut comprising a portion of said annular lip being removed from said annular lip, said frontal turbulence generation structure being an integral part of said baffle element;

a frontal turbulence generation structure that is positioned on the distal side of the baffle element, and whereby said structure comprises an annular inward protruding lip, said lip protruding inwards towards the axis of the suppressor, said lip having a rear surface that decreases in thickness with respect to the center axis of the baffle element, whereby said frontal turbulence generation structure of said baffle element is a separate structure, said structure not being an integral part of said baffle element;

a frontal turbulence generation structure that is positioned on the distal side of the baffle element, and whereby said structure comprises an annular inward protruding lip, said lip protruding inwards towards the axis of the suppressor, said lip having a rear surface that decreases in thickness with respect to the center axis of the baffle element and whereby said frontal turbulence generation structure has at least one geometrical shaped cut, said cut comprising a portion of said annular lip being removed from said annular lip, whereby said frontal turbulence generation structure of said baffle element is a separate structure, said structure not being an integral part of said baffle element integral part of said baffle element;

a frontal turbulence generation structure that is positioned on the distal side of the baffle element, and whereby said structure comprises a short cylindrical spacer element, and an annular inward protruding lip, said lip protruding inwards towards the axis of the suppressor, said lip having a rear surface that decreases in thickness with respect to the center axis of the baffle, said frontal turbulence generation structure being an integral part of said baffle element;

a frontal turbulence generation structure that is positioned on the distal side of the baffle element, and whereby said structure comprises a short cylindrical spacer element, and an annular inward protruding lip, said lip protruding inwards towards the axis of the suppressor, said lip having a rear surface that decreases in thickness with respect to the center axis of the baffle and whereby said frontal turbulence generation structure has at least one geometrical shaped cut, said cut comprising a portion of said annular lip being removed from said annular lip, said frontal turbulence generation structure being an integral part of said baffle element;

a frontal turbulence generation structure that is positioned on the distal side of the baffle element, and whereby said structure comprises a short cylindrical spacer element, and an annular inward protruding lip, said lip protruding inwards towards the axis of the suppressor, said lip having a rear surface that decreases in thickness with respect to the center axis of the baffle, whereby said frontal turbulence generation structure of said baffle element is a separate structure, said structure not being an integral part of said baffle element;

a frontal turbulence generation structure that is positioned on the distal side of the baffle element, and whereby said structure comprises a short cylindrical spacer element, and an annular inward protruding lip, said lip protruding inwards towards the axis of the suppressor, said lip having a rear surface that decreases in thickness with respect to the center axis of the baffle and whereby said frontal turbulence generation structure has at least one geometrical shaped cut, said cut comprising a portion of said annular lip being removed from said annular lip, whereby said frontal turbulence generation structure of said baffle element is a separate structure, said structure not being an integral part of said baffle element; and a turbulence generation structure that is positioned on the distal side of the baffle element, and whereby said structure comprises an annular inward protruding lip, said structure being positioned within said conical section of said baffle, said lip protruding inwards towards the axis of the suppressor, said lip having a rear surface that decreases in thickness with respect to the center axis of the baffle and whereby said turbulence generation structure has at least one geometrical shaped cut, said cut comprising a portion of said annular lip being removed from said annular lip, said structure being an integral part of said baffle element.

2. The sound suppressor of claim 1, including a plurality of baffle elements, said baffle elements being positioned between said proximal rear end cap and said distal front end cap, and a plurality of spacer elements positioned between said proximal rear end cap, said baffle elements, and said distal front end cap.

3. A sound suppressor for a firearm, comprising:

a cylindrical housing;

a proximal rear end cap whereby said proximal rear end cap has means for attachment to said cylindrical housing and has means for attachment to the muzzle of a firearm;

a distal front end cap whereby said distal front end cap has means for attachment to said cylindrical housing and has an aperture for passage of projectiles;

at least one baffle element, and at least one spacer element positioned within said housing, and an expansion chamber, said expansion chamber positioned between the proximal rear end cap and said baffle element;

whereby said baffle element comprises a rear flat flange with a front truncated cone joined by a web or parallel-sided tube, and an expansion chamber positioned between the distal side of said flat flange and the proximal side of said truncated cone and the outside surface of the web or parallel-sided tube and the inside diameter of said cylindrical housing, said baffle element having a central bore that extends from the proximal side of the baffle through to the apex of the front truncated cone or the distal side of the baffle, and whereby said baffle includes at least two of the following features, these features being:

a rearward conical protrusion provided with a plurality of annular steps, said protrusion positioned on the proximal side of the baffle element, said plurality of annular steps positioned concentrically on the rearward conical protrusion, said steps having a flat front surface, and said plurality of annular steps decreasing in diameter with respect to the distance from the proximal side of the baffle element;

a rearward conical protrusion provided with a plurality of annular steps, said protrusion positioned on the proximal side of the baffle element, said plurality of annular steps positioned concentrically on the rearward conical protrusion, said plurality of annular steps decreasing in diameter with respect to the distance to the distance from the proximal side of the baffle element, whereby said plurality of annular steps on said rearward conical protrusion have a tapered front surface, said tapered surface tapering inward from the outside diameter of each step and rearward towards the outside diameter of the next annular step as positioned with respect to the distance from the proximal side of said baffle;

a flange positioned on the exterior surface of the front truncated cone, said flange having a diameter less than the internal diameter of said suppressor housing;

at least two gas ports that are angled with respect to the axis of the baffles, said gas ports being positioned in the rear flat flange;

gas cross-flow enhancement cuts to the bore of the baffle element, whereby said cuts are positioned eccentrically to the bore axis of the baffle, and whereby said cuts are positioned on the proximal and distal sides of the baffle;

a frontal turbulence generation structure that is positioned on the distal side of the baffle element, and whereby said structure comprises an annular inward protruding lip, said lip protruding inwards towards the axis of the suppressor, said lip having a rear surface that decreases in thickness with respect to the center axis of the baffle element, said frontal turbulence generation structure being an integral part of said baffle element;

a frontal turbulence generation structure that is positioned on the distal side of the baffle element, and whereby said structure comprises an annular inward protruding lip, said lip protruding inwards towards the axis of the suppressor, said lip having a rear surface that decreases in thickness with respect to the center axis of the baffle element and whereby said frontal turbulence generation structure has at least one geometrical shaped cut, said cut comprising a portion of said annular lip being removed from said annular lip, said frontal turbulence generation structure being an integral part of said baffle element;

a frontal turbulence generation structure that is positioned on the distal side of the baffle element, and whereby said structure comprises an annular inward protruding lip, said lip protruding inwards towards the axis of the suppressor, said lip having a rear surface that decreases in thickness with respect to the center axis of the baffle element, whereby said frontal turbulence generation structure of said baffle element is a separate structure, said structure not being an integral part of said baffle element;

a frontal turbulence generation structure that is positioned on the distal side of the baffle element, and whereby said structure comprises an annular inward protruding lip, said lip protruding inwards towards the axis of the suppressor, said lip having a rear surface that decreases in thickness with respect to the center axis of the baffle element and whereby said frontal turbulence generation structure has at least one geometrical shaped cut, said cut comprising a portion of said annular lip being removed from said annular lip, whereby said frontal turbulence generation structure of said baffle element is a separate structure, said structure not being an integral part of said baffle element;

a frontal turbulence generation structure that is positioned on the distal side of the baffle element, and whereby said structure comprises a short cylindrical spacer element, and an annular inward protruding lip, said lip protruding inwards towards the axis of the suppressor, said lip having a rear surface that decreases in thickness with respect to the center axis of the baffle and whereby said frontal turbulence generation structure has at least one geometrical shaped cut, said cut comprising a portion of said annular lip being removed from said annular lip, said frontal turbulence generation structure being an integral part of said baffle element;

a frontal turbulence generation structure that is positioned on the distal side of the baffle element, and whereby said structure comprises a short cylindrical spacer element, and an annular inward protruding lip, said lip protruding inwards towards the axis of the suppressor, said lip having a rear surface that decreases in thickness with respect to the center axis of the baffle and whereby said frontal turbulence generation structure has at least one geometrical shaped cut, said cut comprising a portion of said annular lip being removed from said annular lip, said frontal turbulence generation structure being an integral part of said baffle element;

a frontal turbulence generation structure that is positioned on the distal side of the baffle element, and whereby said structure comprises a short cylindrical spacer element, and an annular inward protruding lip, said lip protruding inwards towards the axis of the suppressor, said lip having a rear surface that decreases in thickness with respect to the center axis of the baffle, whereby said frontal turbulence generation structure of said baffle element is a separate structure, said structure not being an integral part of said baffle element;

a frontal turbulence generation structure that is positioned on the distal side of the baffle element, and whereby said structure comprises a short cylindrical spacer element, and an annular inward protruding lip, said lip protruding inwards towards the axis of the suppressor, said lip having a rear surface that decreases in thickness with respect to the center axis of the baffle and whereby said frontal turbulence generation structure has at least one geometrical shaped cut, said cut comprising a portion of said annular lip being removed from said annular lip, whereby said frontal turbulence generation structure of said baffle element is a separate structure, said structure not being an integral part of said baffle element; and a turbulence generation structure that is positioned on the distal side of the baffle element, and whereby said structure comprises an annular inward protruding lip, said structure being positioned within said conical section of said baffle, said lip protruding inwards towards the axis of the suppressor, said lip having a rear surface that decreases in thickness with respect to the center axis of the baffle and whereby said turbulence generation structure has at least one geometrical shaped cut, said cut comprising a portion of said annular lip being removed from said annular lip, said structure being an integral part of said baffle element.

4. The sound suppressor of claim 3, including:

a plurality of said baffle elements positioned within the cylindrical housing between the proximal end and the distal end in a spaced relationship, a plurality of spacer elements positioned within the cylindrical housing between the baffle elements and between the proximal and distal ends of the suppressor, and said plurality of expansion chambers positioned between the proximal end, the baffle elements and the distal end of the sound suppressor.

5. A sound suppressor for a firearm, comprising:

a cylindrical housing;

a proximal rear end cap whereby said proximal rear end cap has means for attachment to said cylindrical housing and has means for attachment to the muzzle of a firearm;

a distal front end cap whereby said distal front end cap has means for attachment to said cylindrical housing and has an aperture for passage of projectiles;

at least one baffle element, and at least one spacer element positioned within said housing, and an expansion chamber, said expansion chamber positioned between the proximal rear end cap and said baffle element;

whereby said baffle element comprises a conical baffle whereby said exit area or major diameter of said conical baffle is slightly less than or close to the internal diameter of said suppressor housing, said conical baffle having a central bore hole, and whereby said baffle includes at least two of the following features, these features being:

a plurality of annular steps positioned on the exterior of the conical baffle, said steps being positioned between the apex of the conical baffle and the exit area or major diameter of the conical baffle, said steps decreasing in diameter with respect to the distance from the exit area of major diameter of the conical baffle, and whereby said annular steps have a tapered front surface whereby said tapered front surface tapers inward from the outside diameter of each step and rearward towards the outer diameter of the next step as positioned with respect to the distance from the exit area or major diameter of the conical baffle;

gas cross-flow enhancement cuts to the bore of the baffle element, whereby said cuts are positioned eccentrically to the bore axis of the baffle, and whereby said cuts are positioned on the proximal and distal sides of the baffle;

a frontal turbulence generation structure that is positioned on the distal side of the baffle element, and whereby said structure comprises an annular inward protruding lip, said lip protruding inwards towards the axis of the suppressor, said lip having a rear surface that decreases in thickness with respect to the center axis of the baffle element, said frontal turbulence generation structure being an integral part of said baffle element;

a frontal turbulence generation structure that is positioned on the distal side of the baffle element, and whereby said structure comprises an annular inward protruding lip, said lip protruding inwards towards the axis of the suppressor, said lip having a rear surface that decreases in thickness with respect to the center axis of the baffle element and whereby said frontal turbulence generation structure has at least one geometrical shaped cut, said cut comprising a portion of said annular lip being removed from said annular lip, said frontal turbulence generation structure being an integral part of said baffle element;

a frontal turbulence generation structure that is positioned on the distal side of the baffle element, and whereby said structure comprises an annular inward protruding lip, said lip protruding inwards towards the axis of the suppressor, said lip having a rear surface that decreases in thickness with respect to the center axis of the baffle element, whereby said frontal turbulence generation structure of said baffle element is a separate structure, said structure not being an integral part of said baffle element;

a frontal turbulence generation structure that is positioned on the distal side of the baffle element, and whereby said structure comprises an annular inward protruding lip, said lip protruding inwards towards the axis of the suppressor, said lip having a rear surface that decreases in thickness with respect to the center axis of the baffle element and whereby said frontal turbulence generation structure has at least one geometrical shaped cut, said cut comprising a portion of said annular lip being removed from said annular lip, whereby said frontal turbulence generation structure of said baffle element is a separate structure, said structure not being an integral part of said baffle element;

a frontal turbulence generation structure that is positioned on the distal side of the baffle element, and whereby said structure comprises a short cylindrical spacer element, and an annular inward protruding lip, said lip protruding inwards towards the axis of the suppressor, said lip having a rear surface that decreases in thickness with respect to the center axis of the baffle, said frontal turbulence generation structure being an integral part of said baffle element;

a frontal turbulence generation structure that is positioned on the distal side of the baffle element, and whereby said structure comprises a short cylindrical spacer element, and an annular inward protruding lip, said lip protruding inwards towards the axis of the suppressor, said lip having a rear surface that decreases in thickness with respect to the center axis of the baffle and whereby said frontal turbulence generation structure has at least one geometrical shaped cut, said cut comprising a portion of said annular lip being removed from said annular lip, said frontal turbulence generation structure being an integral part of said baffle element;

a frontal turbulence generation structure that is positioned on the distal side of the baffle element, and whereby said structure comprises a short cylindrical spacer element, and an annular inward protruding lip, said lip protruding inwards towards the axis of the suppressor, said lip having a rear surface that decreases in thickness with respect to the center axis of the baffle, whereby said frontal turbulence generation structure of said baffle element is a separate structure, said structure not being an integral part of said baffle element;

a frontal turbulence generation structure that is positioned on the distal side of the baffle element, and whereby said structure comprises a short cylindrical spacer element, and an annular inward protruding lip, said lip protruding inwards towards the axis of the suppressor, said lip having a rear surface that decreases in thickness with respect to the center axis of the baffle and whereby said frontal turbulence generation structure has at least one geometrical shaped cut, said cut comprising a portion of said annular lip being removed from said annular lip, whereby said frontal turbulence generation structure of said baffle element is a separate structure, said structure not being an integral part of said baffle element; and a turbulence generation structure that is positioned on the distal side of the baffle element, and whereby said structure comprises an annular inward protruding lip, said structure being positioned within said conical section of said baffle, said lip protruding inwards towards the axis of the suppressor, said lip having a rear surface that decreases in thickness with respect to the center axis of the baffle and whereby said turbulence generation structure has at least one geometrical shaped cut, said cut comprising a portion of said annular lip being removed from said annular lip, said structure being an integral part of said baffle element.

6. A sound suppressor as claimed for in claim 5, including:

a plurality of said baffle elements positioned within the cylindrical housing between the proximal end and the distal end in a spaced relationship, a plurality of spacer elements positioned within the cylindrical housing between the baffle elements and between the proximal and distal ends of the suppressor, and said plurality of expansion chambers positioned between the proximal end, the baffle elements and the distal end of the sound suppressor.

7. A sound suppressor for a firearm, comprising:

a cylindrical housing;

a proximal rear end cap whereby said proximal rear end cap has means for attachment to said cylindrical housing and has means for attachment to the muzzle of a firearm;

a distal front end cap whereby said distal front end cap has means for attachment to said cylindrical housing and has an aperture for passage of projectiles;

at least one baffle element, and at least one spacer element positioned within said housing, and an expansion chamber, said expansion chamber positioned between the proximal rear end cap and said baffle element;

whereby said baffle element comprises a conical baffle whereby said exit area or major diameter of said conical baffle is considerably less than the internal diameter of said suppressor housing, said conical baffle having a central bore hole, and whereby said baffle includes at least two of the following features, these features being:

a plurality of annular steps positioned on the exterior of the conical baffle, said steps being positioned between the apex of the conical baffle and the exit area or major diameter of the conical baffle, said steps decreasing in diameter with respect to the distance from the exit area or major diameter of the conical baffle, and whereby said annular steps have a tapered front surface whereby said tapered front surface tapers inward from the outside diameter of each step and rearward towards the outer diameter of the next step as positioned with respect to the distance from the exit area or major diameter of the conical baffle;

gas cross-flow enhancement cuts to the bore of the baffle element, whereby said cuts are positioned eccentrically to the bore axis of the baffle, and whereby said cuts are positioned on the proximal and distal sides of the baffle;

a frontal turbulence generation structure that is positioned on the distal side of the baffle element, and whereby said structure comprises an annular inward protruding lip, said lip protruding inwards towards the axis of the suppressor, said lip having a rear surface that decreases in thickness with respect to the center axis of the baffle element, said frontal turbulence generation structure being an integral part of said baffle element;

a frontal turbulence generation structure that is positioned on the distal side of the baffle element, and whereby said structure comprises an annular inward protruding lip, said lip protruding inwards towards the axis of the suppressor, said lip having a rear surface that decreases in thickness with respect to the center axis of the baffle element and whereby said frontal turbulence generation structure has at least one geometrical shaped cut, said cut comprising a portion of said annular lip being removed from said annular lip, said frontal turbulence generation structure being an integral part of said baffle element;

a frontal turbulence generation structure that is positioned on the distal side of the baffle element, and whereby said structure comprises a short cylindrical spacer element, and an annular inward protruding lip, said lip protruding inwards towards the axis of the suppressor, said lip having a rear surface that decreases in thickness with respect to the center axis of the baffle, said frontal turbulence generation structure being an integral part of said baffle element;

a frontal turbulence generation structure that is positioned on the distal side of the baffle element, and whereby said structure comprises a short cylindrical spacer element, and an annular inward protruding lip, said lip protruding inwards towards the axis of the suppressor, said lip having a rear surface that decreases in thickness with respect to the center axis of the baffle and whereby said frontal turbulence generation structure has at least one geometrical shaped cut, said cut comprising a portion of said annular lip being removed from said annular lip, said frontal turbulence generation structure being an integral part of said baffle element; and a turbulence generation structure that is positioned on the distal side of the baffle element, and whereby said structure comprises an annular inward protruding lip, said structure being positioned within said conical section of said baffle, said lip protruding inwards towards the axis of the suppressor, said lip having a rear surface that decreases in thickness with respect to the center axis of the baffle and whereby said turbulence generation structure has at least one geometrical shaped cut, said cut comprising a portion of said annular lip being removed from said annular lip, said structure being an integral part of said baffle element.

8. A sound suppressor as claimed for in claim 7, including:

a plurality of said baffle elements positioned within the cylindrical housing between the proximal end and the distal end in a spaced relationship, a plurality of spacer elements positioned within the cylindrical housing between the baffle elements and between the proximal and distal ends of the suppressor, and said plurality of expansion chambers positioned between the proximal end, the baffle elements and the distal end of the sound suppressor.

9. A sound suppressor for a firearm, comprising:

a cylindrical housing;

a proximal rear end cap whereby said proximal rear end cap has means for attachment to said cylindrical housing and has means for attachment to the muzzle of a firearm;

a distal front end cap whereby said distal front end cap has means for attachment to said cylindrical housing and has an aperture for passage of projectiles;

at least one baffle element, and at least one spacer element positioned within said housing, and an expansion chamber, said expansion chamber positioned between the proximal rear end cap and said baffle element;

whereby said baffle element comprises a comprises a flat or almost flat baffle, said baffle having a central bore hole, and whereby said baffle includes at least two of the following features, these features being:

a rearward conical protrusion provided with a plurality of annular steps, said protrusion positioned on the proximal side of the baffle element, said plurality of annular steps positioned concentrically on the rearward conical protrusion, said steps having a flat front surface, and said plurality of annular steps decreasing in diameter with respect to the distance from the proximal side of the baffle element;

a rearward conical protrusion provided with a plurality of annular steps, said protrusion positioned on the proximal side of the baffle element, said plurality of annular steps positioned concentrically on the rearward conical protrusion, said plurality of annular steps decreasing in diameter with respect to the distance from the proximal side of the baffle element, whereby said plurality of annular steps on said rearward conical protrusion have a tapered front surface, said tapered surface tapering inward from the outside diameter of each step and rearward towards the outside diameter of the next annular step as positioned with respect to the distance from the proximal side of said baffle; and gas cross-flow enhancement cuts to the bore of the baffle element, whereby said cuts are positioned eccentrically to the bore axis of the baffle, and whereby said cuts are positioned on the proximal and distal sides of the baffle.

10. A sound suppressor as claimed for in claim 9, including:

a plurality of said baffle elements positioned within the cylindrical housing between the proximal end and the distal end in a spaced relationship, a plurality of spacer elements positioned within the cylindrical housing between the baffle elements and between the proximal and distal ends of the suppressor, and said plurality of expansion chambers positioned between the proximal end, the baffle elements and the distal end of the sound suppressor.

* * * * *